US011305916B2

(12) United States Patent
Todaka

(10) Patent No.: US 11,305,916 B2
(45) **Date of Patent: *Apr. 19, 2022**

(54) ZIPPER TAPE, BAG, AND METHOD FOR PRODUCING BAG

(71) Applicant: IDEMITSU UNITECH CO., LTD., Tokyo (JP)

(72) Inventor: Takumi Todaka, Chiba (JP)

(73) Assignee: IDEMITSU UNITECH CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/132,298

(22) Filed: Dec. 23, 2020

(65) Prior Publication Data

US 2021/0107703 A1 Apr. 15, 2021

Related U.S. Application Data

(62) Division of application No. 16/068,533, filed as application No. PCT/JP2017/000146 on Jan. 5, 2017, now Pat. No. 10,906,701.

(30) Foreign Application Priority Data

Jan. 7, 2016 (JP) ..... 2016-002051

(51) Int. Cl.
*B65D 33/25* (2006.01)
*B65D 81/34* (2006.01)
*A44B 19/16* (2006.01)

(52) U.S. Cl.
CPC ..... *B65D 33/2508* (2013.01); *A44B 19/16* (2013.01); *B65D 33/2541* (2013.01);
(Continued)

(58) Field of Classification Search
CPC ..... B65D 33/2508; B65D 33/2541; B65D 81/3415; B65D 81/3461; B65D 2205/00; A44B 19/16
(Continued)

(56) References Cited

U.S. PATENT DOCUMENTS 4,532,652 A 7/1985 Herrington
7,437,805 B2 10/2008 Berich
(Continued)

FOREIGN PATENT DOCUMENTS

CN 1705593 A 12/2005
CN 1993272 A 7/2007
(Continued)

OTHER PUBLICATIONS

Office action in corresponding CN application 201780005732.1 dated Sep. 2, 2020, {pp. 1-12).
(Continued)

*Primary Examiner* — Jes F Pascua
(74) *Attorney, Agent, or Firm* — Millen, White, Zelano & Branigan, PC; Ryan Pool

(57) ABSTRACT

A zipper tape includes a pair of belt-shaped bases bondable to a film of a bag body, and mutually engageable engagement portion each integrally provided to corresponding one of the belt-shaped bases. One of the belt-shaped bases includes at least two portions having different bonding strengths to the film on a side opposite a side provided with the engagement portion and between an edge of the one of the belt-shaped bases in a width direction orthogonal to a longitudinal direction to a point at which the engagement portions are provided. A bonding strength of a first portion of the at least two portions to the film may be larger than a bonding strength of a second portion to the film.

7 Claims, 18 Drawing Sheets

(52) U.S. Cl.
CPC ..... *B65D 81/3415* (2013.01); *B65D 81/3461* (2013.01); *B65D 2205/00* (2013.01)

(58) Field of Classification Search
USPC ..... 383/63
See application file for complete search history.

(56) References Cited

U.S. PATENT DOCUMENTS

| | | | | |
|---|---|---|---|---|
| 9,227,774 | B2 | 1/2016 | Nanba et al. | |
| 9,550,617 | B2 | 1/2017 | Nanba et al. | |
| 10,906,701 | B2 * | 2/2021 | Todaka | B65D 33/2541 |
| 2006/0257533 | A1 | 11/2006 | Plourde et al. | |
| 2009/0226119 | A1 | 9/2009 | Hatakeyama | |
| 2009/0238500 | A1 | 9/2009 | Nanba et al. | |
| 2012/0314978 | A1 | 12/2012 | Tamaoki et al. | |
| 2015/0375902 | A1 | 12/2015 | Nanba et al. | |
| 2016/0194117 | A1 | 7/2016 | Goto et al. | |
| 2016/0200490 | A1 | 7/2016 | Inaba et al. | |
| 2017/0073118 | A1 | 3/2017 | Nanba et al. | |
| 2021/0139224 | A1 * | 5/2021 | Todaka | B65D 81/3407 |

FOREIGN PATENT DOCUMENTS

| | | | |
|---|---|---|---|
| CN | 101072715 | A | 11/2007 |
| CN | 102753448 | A | 10/2012 |
| CN | 103998350 | A | 8/2014 |
| CN | 105377706 | A | 3/2016 |
| CN | 105473464 | A | 4/2016 |
| EP | 1721833 | A1 | 11/2006 |
| JP | 2000072156 | A | 3/2000 |
| JP | 2000072157 | A | 3/2000 |
| JP | 2006051987 | A | 2/2006 |
| JP | 2009166845 | A | 7/2009 |
| JP | 2013046644 | A | 3/2013 |
| JP | 2014012552 | A | 1/2014 |
| JP | 2014069888 | A | 4/2014 |
| JP | 2015151143 | A | 8/2015 |
| JP | 2019202822 | A | 11/2019 |
| JP | 2021024602 | A * | 2/2021 |
| TW | 200615208 | A | 5/2006 |
| WO | 06062136 | A1 | 6/2006 |
| WO | 11099516 | A1 | 8/2011 |

OTHER PUBLICATIONS

Office action in corresponding Taiwanese patent application No. 106100416 dated Aug. 12, 2020, {pp. 1-13).
Machine translation of JP2000072156A.
Machine translation of JP-2014012552-A.
Supplementary Search Report for EP17735986.6 dated Sep. 5, 2019 (pp. 1-8).
International Search Report for PCT/JP2017/000146 dated Mar. 28, 2017.
English Abstract for JP2013046644, Publication Date: Mar. 7, 2013.
English Abstract for JP2015151143, Publication Date: Aug. 24, 2015.

* cited by examiner

ZIPPER TAPE, BAG, AND METHOD FOR PRODUCING BAG

TECHNICAL FIELD

The present invention relates to a zipper tape, a bag, and a manufacturing method of the bag.

BACKGROUND ART

Bags capable of cooking foods or the like contained therein have been widely used. It is known to provide to such bags a steam vent mechanism, which keeps the bags from being excessively expanded to be burst during cooking (see, for instance, Patent Literature 1).

The bag disclosed in Patent Literature 1 includes a steam vent mechanism having a weakened seal, whose periphery is weakly attached to a bag body so as to close a circular cut provided near one of side seals of the bag body. The weakened seal of the steam vent mechanism is configured to be detached from the bag body when an internal pressure is raised to a predetermined level by steam generated during cooking, so that the steam is discharged through the cut to keep the bag body from being excessively expanded to be burst. In another known example of the steam vent mechanism, the zipper tape in an engaged state is configured to be partially disengaged when the bag body is expanded during cooking.

CITATION LIST

Patent Literature(s)

Patent Literature 1: JP 2013-46644 A

SUMMARY OF THE INVENTION

Problems to be Solved by the Invention

However, the steam vent mechanism provided with the weakened seal as disclosed in Patent Literature 1 requires the steam vent mechanism to be independently provided on the bag, thus complicating the production process. In contrast, in order to provide the zipper tape that is partially disengaged when the bag body is expanded during cooking, an engagement structure configured to be partially disengaged has to be devised, making it difficult to produce the zipper tape itself.

An object of the invention is to provide a zipper tape including a belt-shaped base that can be easily partially peeled off from a film, a bag, and a manufacturing method of the bag.

Means for Solving the Problems

A zipper tape according to an aspect of the invention includes: a pair of belt-shaped bases comprising a first belt-shaped base and a second belt-shaped base each configured to be bonded to a film of a bag body; and an engagement portion comprising a mutually engageable first engagement portion and second engagement portion, the first and second engagement portions being provided integrally with the first and second belt-shaped bases, respectively, in which the first belt-shaped base includes at least two portions including a first portion exhibiting a first bonding strength and a second portion exhibiting a second bonding strength different from the first bonding strength when the zipper tape is bonded to the film, the at least two portions being provided on a first side of the first belt-shaped base opposite a second side of the first belt-shaped base provided with the first engagement portion and between a point at which the first engagement portion is provided and an edge in a width direction orthogonal to a longitudinal direction of the first belt-shaped base, the first bonding strength of the first portion to the film being larger than the second bonding strength of the second portion to the film.

In the above aspect of the invention, the first portion having the first bonding strength to the film and the second portion having the second bonding strength to the film, which is smaller than the first bonding strength between the first belt-shaped base at the first portion and the film, are provided on the first side of the first belt-shaped base (i.e. the side opposite the side provided with the first engagement portion) between the point of the first engagement portion and the edge in the width direction orthogonal to the longitudinal direction of the first belt-shaped base. When the zipper tape of the above aspect of the invention is bonded to the film (i.e. a material of the bag body) to form the bag body, a region of the first belt-shaped base extending over the first and second portions of the zipper tape of the invention is bonded to the film to form a first region.

The first region, at which the first belt-shaped base is bonded to the film, includes a region at which the first portion is bonded to the film and a region at which the second portion is bonded to the film. In a region to be the first region, the bonding strength at a portion corresponding to the bonded portion between the second portion and the film is smaller than the bonding strength at a portion corresponding to the bonded portion between the first portion and the film so that the second portion is easily peelable from the film. Accordingly, by adjusting a ratio of the length of the bonded portion between the first portion and the film and the bonded portion between the second portion and the film on a straight line in the longitudinal direction of the zipper tape, the first belt-shaped base can be designed to be partially peeled from the film at the bonded portion between the second portion and the film.

The engagement portions refer to a pair of members configured to be separated only when being pulled in a direction away from each other for opening and to be kept engaged with each other when not being pulled for opening. Examples of the engagement portion include a male portion and a female portion, and a pair of hook members.

Accordingly, after the zipper tape is attached to the bag body to make a bag, the bag can be subjected to cooking in a microwave oven or hot water while contents are contained in the housing space. When an internal pressure increases in the housing space in the process of cooking, the bonded portion between the second portion and the film, at which the bonding strength is smaller than the bonding strength at the bonded portion between the first portion and the film, is peeled from the film to vent steam. In other words, a vent hole is created at the bonded portion between the second portion and the film.

Herein, the bonding strength refers to a force required in order to separate (peel) two bonded members. For instance, the bonding strength means a magnitude of tensile force when mutually bonded two members are pulled to be separated from each other. The bonding strength between the film and the belt-shaped base refers to a force required in order to separate the film and the belt-shaped base.

The bonding strength at the bonded portion between the first portion and the film may be set to be different from the bonding strength at the bonded portion between the second portion and the film by, for instance, using different resins for the first and second portions. In this case, with the use of a resin as a material of the second portion less compatible to a resin for the film than a resin for the first portion, it is expectable that the bonding strength at the bonded portion between the first portion and the film becomes larger than the bonding strength at the bonded portion between the second portion and the film. The resin for the first portion may be the same as a resin for a surface layer of the first belt-shaped base, or the resin for the first portion may be different from the resin for the first belt-shaped base.

The first and second portions are formed on the first belt-shaped base by, for instance, laminating the first and second portions on the first side of the first belt-shaped base opposite the second side provided with the first engagement portion between the point of the first engagement portion and the edge in the width direction orthogonal to the longitudinal direction of the first belt-shaped base, or integrally extruding resins for the first portion, the second portion, and the first belt-shaped base so that the surfaces of the first and second portions are flush with the side of the first belt-shaped base provided with the first engagement portion.

In the above aspect of the invention, one of the pair of belt-shaped bases may include an extension at an end opposite a part provided with the first and second portions with respect to the point at which the first engagement portion is provided in the width direction orthogonal to the longitudinal direction of the one of the belt-shaped bases when the engagement portion is engaged, the extension being extended beyond a length of the other of the belt-shaped bases, the extension may be provided with a sealable portion on a side provided with the first engagement portion, the sealable portion being belt-shaped along the longitudinal direction and bondable to the film, and the sealable portion is bondable to the film with a bonding strength smaller than the first bonding strength between the first belt-shaped base at the first portion and the film.

According to the above arrangement, the extension is provided on one of the pair of belt-shaped bases. The extension is provided with the sealable portion, which is bonded to the film to form a second region, the bonding strength at the sealable portion being smaller than the first bonding strength between the first belt-shaped base at the first portion and the film. When the zipper tape of the above aspect of the invention is bonded to the film to form the bag body, the extension is bonded to the film at the sealable portion to form the second region.

It should be noted that the one of the belt-shaped bases provided with the extension may be the first belt-shaped base provided with the first and second portions, or the second belt-shaped base not provided with the first and second portions.

Accordingly, when the zipper tape is attached to the bag body to make a bag, the sealable portion is easily peeled from the film of the bag body by holding two parts of an opening periphery of the bag body with both hands to disengage the engagement portion and applying a force to the bag in a direction for moving the hands away from each other.

Though the extension is provided to either one of the pair of belt-shaped bases as long as the sealable portion is formed, when the extension is formed on the first belt-shaped base provided with the first and second portions, the steam vent hole can be formed only by peeling the bonded portion between the second portion and the film without peeling the sealable portion from the film of the bag body.

In the above aspect of the invention, one of the pair of belt-shaped bases may include an extension at an end opposite a part provided with the first and second portions with respect to the point at which the first engagement portion is provided in the width direction orthogonal to the longitudinal direction of the one of the belt-shaped bases when the engagement portion is engaged, the extension being extended beyond a length of the other of the belt-shaped bases, the extension may be provided with a cut portion, at which the extension is configured to be cut in the width direction, along the longitudinal direction of the one of the belt-shaped bases, and the extension may be provided with a bondable region bondable to the film at a part opposite the engagement portion with respect to the cut portion.

According to the above arrangement, the extension is provided to one of the pair of belt-shaped bases, the cut portion is provided to the extension, and the bondable region is provided to the extension. The bondable region is bonded to the film to form the bonding region. When the zipper tape of the above aspect of the invention is bonded to the film to form the bag body, the extension is bonded to the film at the bondable region to form the bonding region.

The bonding strength to the film at the bondable region of the extension is larger than the bonding strength of the second portion to the film, and is so large that the bondable region is not peeled from the film by an increase in the internal pressure within the housing space of the bag.

The cut portion is a part whose rigidity is reduced enough to allow the extension to be cut at the cut portion. The cut portion is formed by, for instance, reducing the thickness as compared with the second portion, providing void(s) or perforations (holes arranged in a form of a dotted line), or using a material softer and more easily tearable material than the second portion.

The cut portion has such strength that the cut portion is not torn by an increase in the internal pressure but is tearable when a user disengages the engagement portion to open the bag.

Accordingly, after the zipper tape is attached to the bag body to make a bag, the extension is easily torn at the cut portion to be peeled from the bag body when two parts of an opening periphery of the bag body are held with both hands to disengage the engagement portion and a force is applied to the bag in a direction for moving the hands away from each other. Accordingly, the above arrangement allows the extension to be torn apart.

It should be noted that the extension may be formed on any one of the pair of belt-shaped bases as long as the bondable region can be formed.

In the above aspect of the invention, the engagement portion may include a male portion and a female portion, and the first and second portions may be provided on one of the belt-shaped bases provided with the female portion.

According to the above arrangement, the first belt-shaped base provided with the female portion can be cantilevered on the bag body (i.e. only an area in the width direction provided with the first region is attached).

According to the above arrangement, even when the pressure in the bag body of the bag provided with the zipper tape of the invention increases, the internal pressure is prevented from concentrating at the engagement portion, so that the engagement portion is kept from being disengaged, and it is expectable that the internal pressure concentrates at the first region.

In the above aspect of the invention, the first portion may be made of polypropylene, and the second portion may be made of a mixture layer of polyethylene and polypropylene.

According to the above arrangement, when at least a part of the film of the bag body to be bonded to the first belt-shaped base is formed of polypropylene, the bonding strength between the first portion and the film can be enhanced by forming the first portion from polypropylene. When the second portion is formed from the mixture layer of polyethylene and polypropylene, the bonding strength between the second portion and the film can be made lower than the bonding strength between the first portion and the film. Accordingly, when an internal pressure increases in the housing space, the bonded portion between the second portion and the film, at which the bonding strength is smaller than the bonding strength at the bonded portion between the first portion and the film, is peeled from the film.

It should be noted that the bonding strength between the second portion and the film is adjustable by changing a mixture ratio of polyethylene and polypropylene.

In the above aspect of the invention, the pair of belt-shaped bases may be connected to each other via a connecting portion at an end opposite an area provided with the first and second portions with respect to the point at which the first engagement portion is provided, in the width direction orthogonal to the longitudinal direction of the belt-shaped bases.

Since the pair of belt members are connected via the connecting portion in the above arrangement, even highly fluid contents can be prevented from flowing out. In addition, the contents can be easily taken out by cutting the connecting portion.

The connecting portion connects ends of the pair of belt members. When the engagement portion is disengaged to open the bag body, only the connecting portion is torn while the belt-shaped bases are not torn. In order to selectively tear the connecting portion, for instance, the connecting portion may be thinner than the belt-shaped base, or the connecting portion may be made of a resin softer than the resin for the belt-shaped bases.

In an embodiment of the invention, projections are provided to respective ones of the pair of belt-shaped bases along the longitudinal direction of the connecting portion.

The projections provided to respective ones of the pair of belt-shaped bases in the above arrangement provide clear marks for borders between the connecting portion and the belt-shaped bases, to allow the connecting portion to be easily cut along the projections.

A bag according to another aspect of the invention includes: a bag body including a housing space configured to contain contents therein; and the zipper tape according to the above aspect of the invention, the zipper tape being attached to an inner surface of the bag body, in which the first and second portions and the bag body are bonded to form a first region, and a first bonded portion between the first portion and the bag body and a second bonded portion between the second portion and the bag body are at least partially not overlapped on a straight line along the longitudinal direction of the first belt-shaped base of the zipper tape.

It should be noted that an end of the first belt-shaped base provided with the first and second portions of the zipper tape of the invention, which is opposite the area provided with the first and second portions, is not bonded to the bag body. According to the above aspect of the invention, when the internal pressure in the housing space of the bag body increases, a force acts along the width direction of the belt-shaped bases in a direction for shearing the belt-shaped bases of the zipper tape. It is expectable that the shearing force enhances the engagement of the engagement portion, whereby disengagement of the engagement portion can be prevented by the internal pressure. It should be noted that the internal pressure concentrates on the first region to peel the first belt-shaped base from the bag body at the second bonded portion between the second portion and the bag body, at which the bonding strength is small, to create a steam vent hole.

According to the above aspect of the invention, the internal pressure in the housing space, which is resulted from cooking in a microwave oven or hot water with contents being contained in the housing space, acts to selectively peel the second portion from the bag body to vent the steam due to the smaller bonding strength between the second portion and the bag body than the bonding strength between the first portion and the bag body in the first belt-shaped base. Thus, the internal pressure can leak to prevent leakage of the contents and bursting of the bag body.

The phrase "a first bonded portion between the first portion and the bag body and a second bonded portion between the second portion and the bag body are at least partially not overlapped on a straight line along the longitudinal direction of the first belt-shaped base of the zipper tape" means that the second bonded portion between the second portion and the bag body has at least one part not overlapped with the first bonded portion of the first portion and the bag body in the longitudinal direction of the zipper tape. Specifically, at at least one part in the longitudinal direction of the zipper tape, the second bonded portion between the second portion and the bag body is provided, and the bonding region between the first portion and the bag body is not provided in the width direction of the zipper tape.

The size of the steam vent hole(s) can be adjusted by changing a ratio of the region(s) devoid of the bonding portion between the first portion and the bag body to a length of the first region along the longitudinal direction of the first belt-shaped base. In the above aspect of the invention, the portion through which the steam is vented is created by peeling the first belt-shaped base of the zipper tape from the bag body at the second bonded portion between the second portion and the bag body with small bonding strength to the film. The steam vent hole is not created in the first bonded portion between the first portion and the bag body, at which the bonding strength to the film is large. By changing the size of the steam vent hole, the degree of heating by a microwave oven or the like can be adjusted. In order to vent the steam at a small internal pressure, a relative length of the region devoid of the bonding portion between the first portion and the bag body in the width direction of the belt member at the bonding portion between the second portion and the bag body is reduced in the longitudinal direction of the zipper tape.

A bag according to still another aspect of the invention includes: a bag body including a housing space configured to contain contents therein; and the zipper tape according to the above aspect of the invention, the zipper tape being attached to an inner surface of the bag body, in which the first and second portions and the bag body are bonded to form a first region, a first bonded portion between the first portion and the bag body and a second bonded portion between the second portion and the bag body are at least partially not overlapped on a straight line along the longitudinal direction of the first belt-shaped base of the zipper tape, and the one of the belt-shaped bases provided with the extension is bonded to a first part of the film of the bag facing a second part of the film of the bag bonded with the other one of the belt-shaped bases not provided with the extension, the one of the belt-shaped bases being bonded to the second part of the film in parallel to the other one of the belt-shaped bases not provided with the extension along the longitudinal direction of the zipper tape at the sealable portion to form a second region.

According to the above arrangement, the extension is provided with the sealable portion bonded to the film to form the second region, the bonding strength at the sealable portion being smaller than the first bonding strength between the first belt-shaped base at the first portion and the film.

Accordingly, the sealable portion, which defines the second region, is peeled from the film of the bag body by holding two parts of an opening periphery of the bag body with both hands to disengage the engagement portion and applying a force to the bag in a direction for moving the hands away from each other, thereby bringing the housing space to be accessible from the outside.

The bag of the above arrangement can prevent the contents (e.g. fluid food such as soup, and sauce for bean curd Szechuan style) contained in the housing space of the bag body from being in contact with the engagement portion, thereby preventing the contents from spattering around when the bag is opened. The bag of the above arrangement is suitable for a retort sterilization treatment after the contents are put in.

The bonded portion between the sealable portion of the second region and the bag body may have any shape as long as the bag is bondable to the one of the belt-shaped bases. For instance, the peripheral end of the bonded portion near the opening of the bag may have a waveform of linear or curved line along the longitudinal direction of the belt-shaped base.

In the above aspect of the invention, a peripheral edge of the second region near an opening may be wave-shaped along the longitudinal direction of the one of the belt-shaped bases.

According to the above arrangement, since the sealable portion is bonded to the film in a wave shape along the longitudinal direction of the one of the belt-shaped bases, when, for instance, an opening periphery of the bag body is held by both hands to apply a force to the bag body in a direction for separating the opening periphery, the force concentrates on the wave-shaped portion, thereby allowing the one of the belt-shaped bases and the film of the bag body to be separated at the second region with a relatively small force. Further, the bonding strength can be easily adjusted by, for instance, increasing the curvature of the waveform near the housing space containing the contents to strengthen resistance against the internal pressure. It should be noted that the wave shape herein is not necessarily curved but may have an at least partially linear outline.

In the above aspect of the invention, the second bonded portion, at which the second portion and the bag body are bonded, may include a plurality of regions, at which the first portion and the bag body are not bonded, in the width direction of the one of the belt-shaped bases.

According to the above arrangement, the plurality of regions, at which the first portion is not bonded to the bag body, are provided at the second bonded portion between the second portion and the bag body in the width direction of the belt member, so that the internal pressure can leak through the plurality of regions upon an increase in the internal pressure in the housing space, thereby adjusting the internal pressure to an appropriate level depending on the content.

In the above aspect of the invention, the second bonded portion, at which the second portion is bonded to the bag body, may be pointed to be projected from a side opposite the housing space toward the housing space at one or more positions in the longitudinal direction of the first belt-shaped base.

According to the above arrangement, since the bonded region between the second portion and the bag body are pointed, when the internal pressure in the housing space of the bag body increases, the internal pressure concentrates on the pointed portion to cause the second portion to be easily peeled from the bag body, thereby creating the steam vent hole.

Further, the first portion is not bonded to the bag body in the width direction at the region provided with the pointed projection on the first belt-shaped base, so that the steam vent hole can be appropriately formed in the region provided with the pointed projection.

The pointed projection herein refers to any form of projection, which includes, for instance, a polygonal shape including triangle and quadrangle, and a circle in a plan view.

In the above aspect of the invention, the bag body may include a facing pair of flat portions, and a bottom portion.

According to the above arrangement, the bag body of the above shape allows the bag to stand upright with the contents being contained in the housing space. Accordingly, when the bag is opened by disengaging the engagement portion, the bag is not likely to tumble over, so that the contents do not leak out from the bag. Further, since the bag can stand upright on a turntable of a microwave oven when the contents (e.g. fluid food) contained in the bag are heated by the microwave oven, the bag is unlikely to tumble on the turntable and the contents are not likely to unexpectedly leak to the outside even with the bag being opened or insufficiently reclosed after once being opened.

In the above aspect of the invention, the bag body may be a gusset bag including a facing pair of flat portions, a pair of lateral portions interposed between the flat portions at lateral peripheral edges of the flat portions, and a bottom portion, the lateral portions and the bottom portion being interfolded inward along a bend line.

According to the above arrangement, the bag body in a form of the gusset bag allows the bag to stand upright with the contents being contained in the housing space in the same manner as the above.

In the above aspect of the invention, an end of the zipper tape opposite a part provided with the bonded portions between the first and second portions and the bag body with respect to the first engagement portion may be not bonded to the bag body.

According to the above arrangement, since the zipper tape is cantilevered to the bag body, the internal pressure concentrates not on the engagement portion of the zipper tape but on the bonded region between the second portion and the bag body, so that the steam vent hole can be appropriately formed in the bonded region between the second portion and the bag body.

In the above aspect of the invention, an end of the bag body opposite the housing space across the pair of belt-shaped bases may be not bonded.

According to the above arrangement, desired contents can be put into the housing space through the non-bonded peripheral end of the bag body by disengaging the engagement portion, and the contents can be heated by a microwave oven. Unlike heating the bag containing a food manufactured by a food manufacturer in the housing space in a microwave oven, a purchaser of the bag can put the purchaser's favorite food in the housing space of the bag and can cook the contents in a microwave oven with the bag being sealed by the zipper tape.

In other words, the bag whose peripheral end of the bag body is not sealed can be used as a cooking tool.

A manufacturing method according to a further aspect of the invention is for manufacturing a bag including a bag body made of a film and defining therein a housing space configured to contain a content, and a zipper tape including a pair of belt-shaped bases bonded to an inner surface of the bag body and mutually engageable engagement portion including first and second engagement portions integrally provided to corresponding one of the belt-shaped bases, the method including: forming at least two portions on one of the pair of belt-shaped bases, the at least two portions including a first portion exhibiting a first bonding strength and a second portion exhibiting a second bonding strength different from the first bonding strength when the zipper tape is bonded to the film, the at least two portions being provided on a first side of the one of the belt-shaped bases opposite a second side of the one of the belt-shaped bases provided with the first engagement portion and between a point, at which the first engagement portion is provided, and an edge of the one of the belt-shaped bases in a width direction orthogonal to a longitudinal direction of the one of the belt-shaped bases; and bonding only a part of the one of the belt-shaped bases onto the film, the part of the one of the belt-shaped bases being opposite the housing space of the bag body with respect to the first engagement portion in the width direction orthogonal to the longitudinal direction of the one of the belt-shaped bases so that the first bonding strength of the first portion to the film is larger than the second bonding strength of the second portion to the film.

The above aspect of the invention provides a method capable of partially peeling the one of the belt-shaped bases from the film with a simple structure.

In order to provide "the first bonding strength of the first portion to the film" "larger than the second bonding strength of the second portion to the film", for instance, different resins are used for the first and second portions. The first portion is exemplarily made of polypropylene, while the second portion is exemplarily made of a mixture layer of polyethylene and polypropylene.

DESCRIPTION OF EMBODIMENT(S)

A bag according to exemplary embodiments of the invention will be described below with reference to the attached drawings.

Bags in the exemplary embodiments are exemplarily packaging bags for cooking. However, the invention is applicable not only to the packaging bags for cooking but also to packaging bags for packaging various articles including food, medicine, medical products, stationery, and miscellaneous goods.

First Exemplary Embodiment

Figure 1:
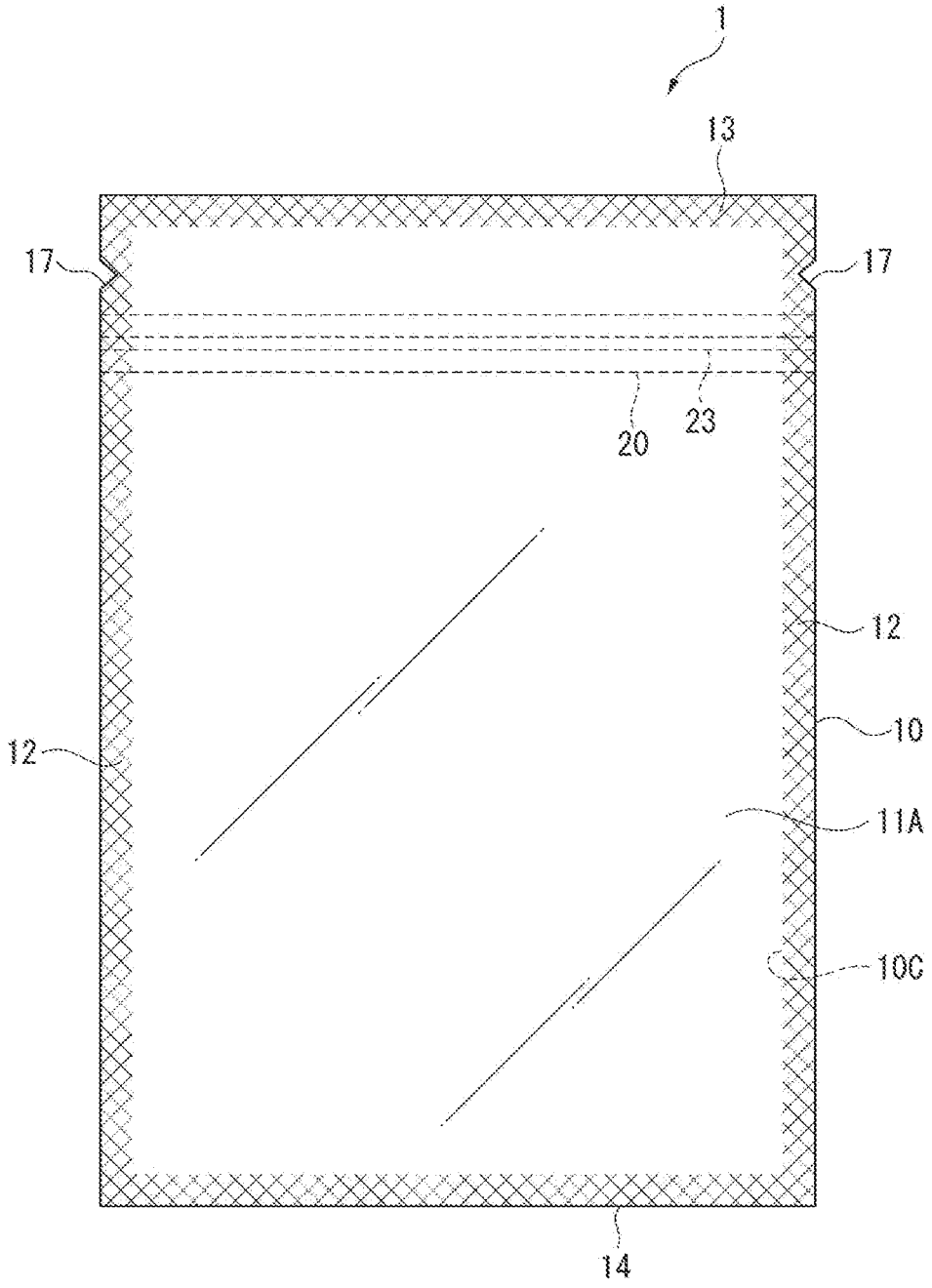
FIG. 1 is a plan view showing a bag according to a first exemplary embodiment of the invention.
Figure 2:
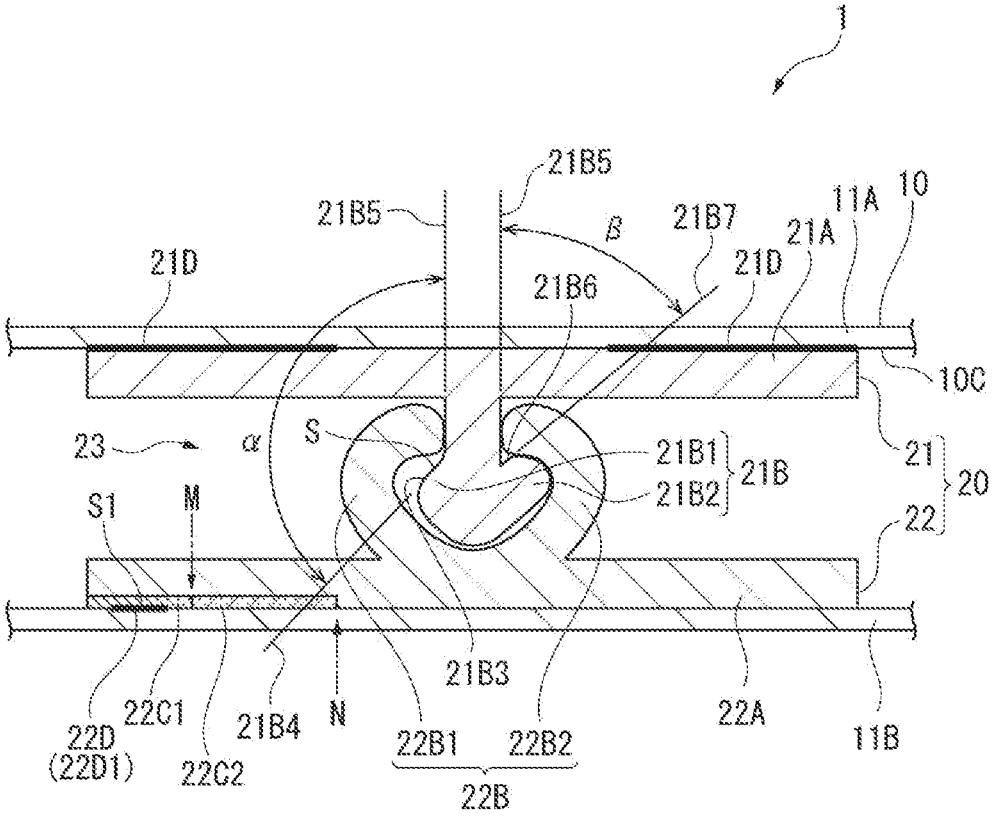
FIG. 2 is a cross sectional view taken along II-II line in FIG. 4B.
Figure 3:
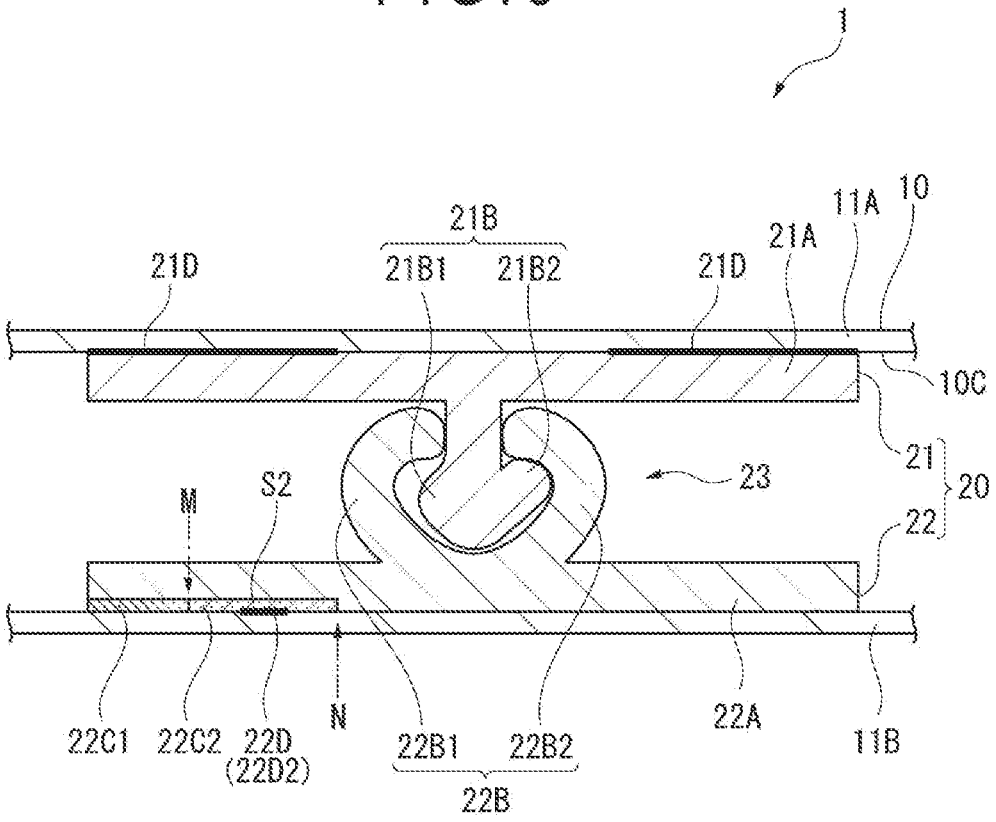
FIG. 3 is a cross sectional view taken along III-III line in FIG. 4B.

FIGS. 1 to 7B show a first exemplary embodiment of the invention. Arrangement of Bag FIG. 1 is a plan view of a bag. FIG. 2 is a cross sectional view taken along II-II line in FIG. 4B. FIG. 3 is a cross sectional view taken along III-III line in FIG. 4B. FIGS. 4A and 4B are plan views of a zipper tape of the bag, showing a heat seal portion of a male member and a heat seal portion of a female member, respectively.

As shown in FIGS. 1 to 3, a bag 1 includes a rectangular (in a plan view) bag body 10, which is formed, for instance, by a three-sided-bag making method and configured to contain non-illustrated contents, and a zipper tape 20 that is attached (bonded) to an inner surface of the bag body 10 by, for instance, heat-sealing.

Arrangement of Bag Body

The bag body 10 is formed by overlapping films 11A, 11B (only the film 11A is shown in FIG. 1). A pair of side seals 12, a top seal 13 and a bottom seal 14 are provided on the periphery of the bag body 10.

The side seals 12, the top seal 13, and the bottom seal 14 of the bag body 10 define a housing space 10C for containing the contents therein.

The zipper tape 20 is attached to the films 11A, 11B of the bag body 10, which face each other.

It should be noted that non-illustrated flattened point seals are provided in the side seals 12 of the bag body 10 at positions of longitudinal ends of the zipper tape 20.

It should also be noted that notches 17 are cut into the bag body 10 between intersections of the longitudinal ends of the zipper tape 20 and peripheries of the side seals 12 of the bag body 10, and intersections of the top seal 13 and the peripheries of the side seals 12.

The films 11A, 11B are each a single-layered or multi-layered film made of a thermoplastic resin such as LLDPE (Linear Low Density Polyethylene), and PP (Polypropylene). As a top layer material of the multilayered film, for instance, Oriented Polypropylene (OPP), Oriented Polyethylene Terephthalate (OPET), Oriented Nylon (ONy), and Cast Polypropylene (CPP) are usable. The multilayered film may include an inorganic layer provided by aluminum vapor deposition, aluminum foil lamination or the like for the purpose of a so-called gas barrier, light blocking and the like.

Though the thickness of the films 11A, 11B is not limited to a specific value as long as the films 11A, 11B are applicable to a packaging material, it is preferable that the thickness ranges from 10 μm to 200 μm. The thickness of less than 10 μm sometimes impairs sealing strength and bag strength. In contrast, with the thickness exceeding 200 μm, the bag strength is sometimes so strong that the films are not easily bent and, consequently, the bag are not easily opened.

Arrangement of Zipper Tape

Detailed arrangement of the zipper tape 20 is shown in FIGS. 2, 3, 4A and 4B.

As shown in FIGS. 2 and 3, the zipper tape 20 includes a male member 21 and a female member 22 that are engageable with each other.

The male member 21 and the female member 22 are attached (e.g. heat-sealed or adhered) to inner surfaces of the films 11A, 11B, which face each other.

The male member 21 includes a male belt-shaped base 21A that is attached (e.g. heat-sealed) to the inner surface of the bag body 10, and a male portion 21B (male hook) continuous with the male belt-shaped base 21A. The male portion 21B is formed along a longitudinal direction of the male belt-shaped base 21A (i.e. in a direction passing through the page of FIG. 2).

The male portion 21B includes a first male claw 21B1 projecting in a direction away from the housing space 100, and a second male claw 21B2 projecting in a direction away from the first male claw 21B1.

The first male claw 21B1 has a bulging cross section having an opening-side slant 21B3 facing the male belt-shaped base 21A, where a tangent line 21B4 of the opening-side slant 21B3 and a perpendicular line 21B5 of the male belt-shaped base 21A define an angle α greater than 90 degrees.

In contrast, the second male claw 21B2 has a hook-shaped cross section having a housing-side slant 21B6 facing the male belt-shaped base 21A, where a tangent line 21B7 of the housing-side slant 21B6 and a perpendicular line 21B5 of the male belt-shaped base 21A define an angle β smaller than 90 degrees.

It should be noted that, when the opening-side slant 21B3 is a flat surface, the tangent line 21B4 refers to a tangent line of the flat surface. When the opening-side slant 21B3 is curved, the tangent line 21B4 refers to a tangent line passing through an inflection point S. The same applies to the tangent line 21B7.

Figure 4A:
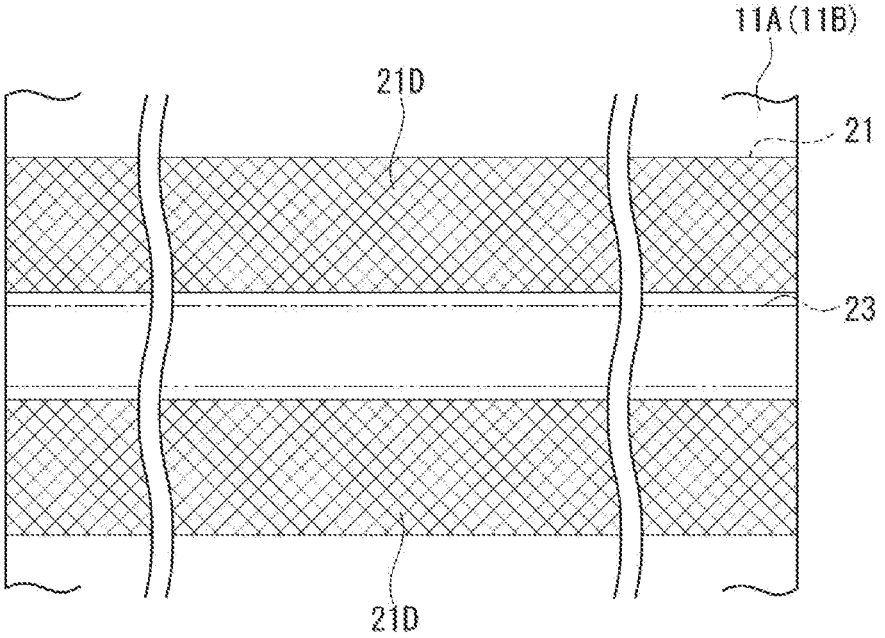
FIG. 4A is a plan view showing a heat seal portion of a male member of a zipper tape.

As shown in FIGS. 2 and 4A, the male member 21 is attached to the bag body 10 through a pair of male-side seal portions 21D. The pair of male-side seal portions 21D are formed by attaching (e.g. heat-sealing) ends of the male belt-shaped base 21A in the width direction (i.e. parts except for a part corresponding to the engagement portion 23) onto one of the films 11A (or 11B) of the bag body 10.

The female member 22 includes a female belt-shaped base 22A that is attached (e.g. heat-sealed) to the inner surface of the bag body 10, and a female portion 22B (female hook) projected from the female belt-shaped base 22A to be engageable with the male portion 21B. The female portion 22B is formed along a longitudinal direction of the female belt-shaped base 22A (i.e. in a direction passing through the page of FIG. 2).

The female portion 22B includes an opposing pair of a first female claw 22B1 engageable with the first male claw 21B1 and a second female claw 22B2 engageable with the second male claw 21B2.

The male portion 21B and the female portion 22B of the zipper tape 20 in combination define an engagement portion 23 at which the zipper tape 20 is engageable/disengageable.

A tight seal layer 22C1 including a first portion S1 and an easy-peel layer 22C2 including a second portion S2, each of which extends in a longitudinal direction of the female belt-shaped base 22A, are provided on a side of the female member 22 opposite the side provided with the female portion 22B. The tight seal layer 22C1 is a belt-shaped layer formed in a region between a first edge opposite the housing space 100 and a predetermined position M near the female portion 22B in a width direction of the female belt-shaped base 22A. The easy-peel layer 22C2 is a belt-shaped layer formed in a region in the width direction of the female belt-shaped base 22A between the predetermined position M near the female portion 22B with respect to the first edge opposite the housing space 100, and a position N of the female portion 22B. It should be noted that, though the sides of the female belt-shaped base 22A, the tight seal layer 22C1, and the easy-peel layer 22C2 to be bonded with the bag body 10 are illustrated to be flush with each other in FIGS. 2 and 3 for the convenience of description, the tight seal layer 22C1 and the easy-peel layer 22C2 may be laminated on a flat female belt-shaped base 22A.

A peel-strength of the easy-peel layer 22C2 from the film 11B (11A), to which the easy-peel layer 22C2 is heat-sealed, is preferably approximately 1 to 20 N/15 mm (width), especially preferably approximately 1 to 15 N/15 mm (width). It should be noted that how the easy-peel layer 22C2 is peeled from the film 11B (11A) (e.g. layer peeling or cohesive peeling) is appropriately determined in view of the usage of the bag 1 or the like.

The bonding strength of the tight seal layer 22C1, which is to be heat-sealed with the film 11B (11A), is higher than the bonding strength of the easy-peel layer 22C2 to the film 11B (11A).

The tight seal layer 22C1, the easy-peel layer 22C2, and the female member 22 can be integrally formed by, for instance, co-extrusion.

Thus, the bonding strength of the first portion S1 (a part of the tight seal layer 22C1) with film 11B (11A) can be higher than the bonding strength of the second portion S2 (a part of the easy-peel layer 22C2) to the film 11B (11A).

Figure 4B:
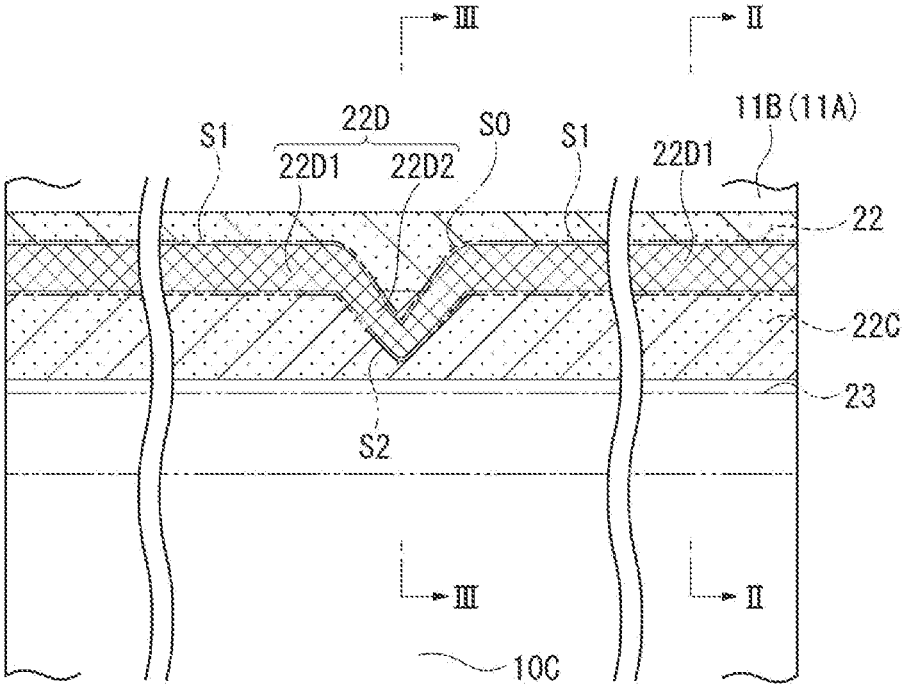
FIG. 4B is a plan view showing a heat seal portion of a female member of the zipper tape.

As shown in FIGS. 2, 3 and 4B, the female member 22 is "cantilevered" to the bag body 10 only through a first region 22D formed by attaching the first portion S1 and the second portion S2 onto the film 11B. The first portion S1 and the second portion S2 define a region S0 in which the first region 22D can be formed.

The first region 22D is formed by attaching (e.g. heat-sealing) the female belt-shaped base 22A only at the first edge in the width direction, which is opposite the housing space 10C of the bag body 10 with respect to the engagement portion 23, onto one of the films 11A (or 11B) of the bag body 10.

The first region 22D includes: first bonding portions 22D1, at which the first portion S1 near the first edge in the width direction of the female belt-shaped base 22A with respect to the predetermined position M is sealed onto the film 11B; and a second bonding portion 22D2, at which the second portion S2 (a part of the easy-peel layer 22C2) is sealed onto the film 11B so that the second boning portion 22D2 projects toward the housing space 100 with respect to the first bonding portion 22D1.

The first bonding portions 22D1 are provided on both sides of the second bonding portion 22D2, each of the first bonding portions 22D1 being in a form of a linear band of a predetermined width on the tight seal layer 22C1 along the border between the tight seal layer 22C1 and the easy-peel layer 22C2.

The second bonding portion 22D2 is a pointed V-shaped part projecting toward the housing space 10C. The second bonding portion 22D2 is adapted to be easily peeled from the film 11B from a pointed end of the projection. The term "pointed" end refers to an acute end, which specifically is in a form of a triangle in a plan view.

Regions (two in total), at which the second portion S2 is bonded to the film 11B and the first portion S1 is not bonded to the film 11B, are provided on both sides of the second portion S2 in the width direction of the female belt-shaped base 22A.

An end of each of the first portions S1 connected with the second portion S2 has a triangular configuration in a plan view. The triangular region is connected to an end of the second portion S2. In the exemplary embodiment, the region of each of the first portions S1 connected with the second portion S2 overlaps the second portion S2 in the width direction of the female belt-shaped base 22A. It should be noted that the first portion and the bag body are not bonded except for the connected region. In other words, the first bonding portion 22D1 and the second bonding portion 22D, at which the first portion S1 and the second portion S2 respectively are connected with the film 11B, do not overlap each other on a longitudinal straight line of the female belt-shaped base 22A.

In the first exemplary embodiment, a planar shape of the tight seal layer 22C1 may conform to the shape of the first portion S1, and/or a planar shape of the easy-peel layer 22C2 may conform to the shape of the second portion S2. However, as shown in FIG. 4B, with the planar shapes of the tight seal layer 22C1 and the easy-peel layer 22C2 being larger than the planar shapes of the first portion S1 and the second portion S2, respectively, the first region 22D can be reliably formed irrespective of slight misalignment when a later-described seal bar is used for attachment to the film 11B.

The zipper tape 20 is made of, for instance, a polyolefin resin.

Preferable examples of the polyolefin resin include polyethylene resin such as low-density polyethylene and linear low-density polyethylene and polypropylene resin. Examples of the polypropylene resin include homo-polypropylene (H-PP), block-polypropylene (B-PP), random polypropylene (R-PP), propylene-ethylene-butene1 random ternary copolymer.

Incidentally, when random propylene (RPP) is used, a melt flow rate (MFR) of the RPP preferably ranges from 0.5 to 20 g/10 min and further preferably ranges from 1 to 15 g/10 min. When the MFR of the random polypropylene is less than 0.5 g/10 min, extrudability of the engagement portion 23 is sometimes deteriorated in continuously and integrally molding the male member 21 and the female member 22. In contrast, when the MFR is larger than 20 g/10 min, the ends of the first female claw 22B1 and the second female claw 22B2 of the female member 22 are likely to come close to or in contact with each other and/or the male portion 21B of the male member 21 is likely to be tilted, thereby making it difficult to extrude a component of a predetermined reclosable shape.

The tight seal layer 22C1 including the first portion S1 is made of, for instance, polypropylene.

The easy-peel layer 22C2 including the second portion S2 is, for instance, made of polyethylene, or a mixture layer of polyethylene and polypropylene. Specifically, the easy-peel layer 22C2 is made of, for instance, linear low-density polyethylene (LLDPE), a mixture of low-density polyethylene (LDPE) and high-density polyethylene (HDPE), a mixture of low-density polyethylene (LDPE) and polypropylene or the like.

A ratio of polypropylene is preferably in a range from 10 mass % to 60 mass % in order to secure an appropriate peel-strength, especially preferably from 20 mass % to 60 mass %. In other words, when polypropylene accounts for, for instance, about 10 mass % of the mixture, the peel-strength after a retort process is greatly reduced. However, such a reduction can be avoided when the above-mentioned mixture ratio is employed.

It should be noted that the resin for the tight seal layer 22C1 may be the same as the resin for the female member 22.

When the resin for the tight seal layer 22C1 is different from the resin for the female member 22, the resin for the tight seal layer 22C1 preferably has a melting point lower than that of the resin for the female member 22.

Manufacture of Bag

Next, a machine and a method for manufacturing the bag 1 will be described below.

Initially, a method for manufacturing a bag before housing contents will be described.

Herein, a method for producing the bag 1 by providing the side seals 12 and the top seal 13 to the films 11A, 11B attached with the zipper tape 20, putting the contents through an input opening at the bottom, and providing the bottom seal 14 to contain the contents, will be described to be contained. It should be noted that the contents are not necessarily put through the input opening at the bottom. Further, the bag is not necessarily made by the later-described three-sided-bag making method but may be made by various methods.

The machine for manufacturing the bag 1 is exemplarily a three-side-seal bag-making machine (not shown). The three-side-seal bag-making machine includes a film feeder configured to feed the films 11A, 11B, a tape feeder configured to feed the zipper tape 20, a tape attachment unit configured to attach the zipper tape 20 to the films 11A, 11B, and a bag-making unit configured to form the side seals 12 and the top seal 13 to the films 11A, 11B to form a bag. The manufacturing machine of the first exemplary embodiment may have the same arrangement as typically known arrangements except for the tape attachment unit.

Figure 5A:
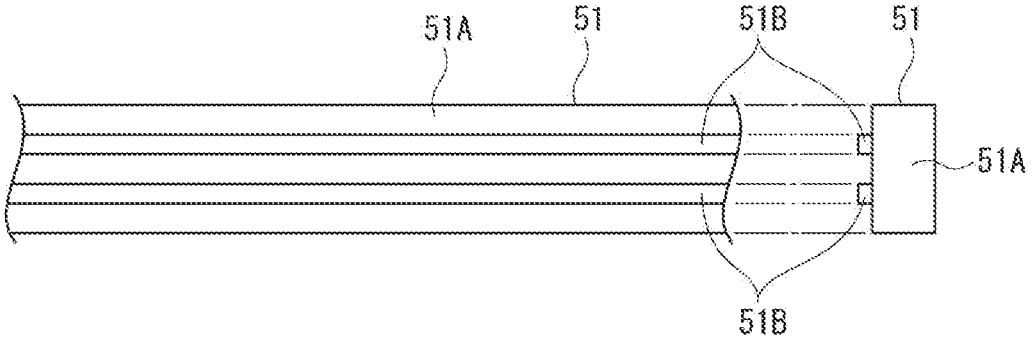
FIG. 5A illustrates a male seal bar for hermetically attaching the male member of the zipper tape.
Figure 5B:
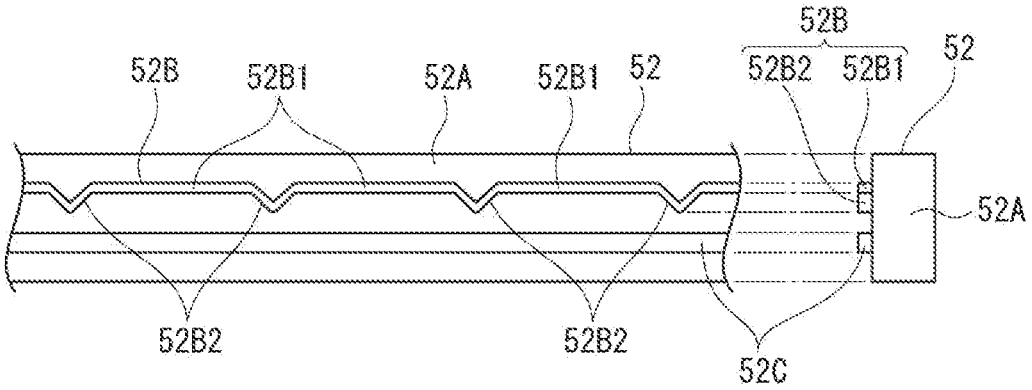
FIG. 5B illustrates a female seal bar for hermetically attaching the female member of the zipper tape.

The tape attachment unit includes seal bars as shown in FIGS. 5A and 5B.

FIG. 5A shows a male seal bar for heat-sealing the male member. FIG. 5B shows a female seal bar for heat-sealing the female member.

As shown in FIG. 5A, one of the pair of the seal bars, which is configured to heat-seal the male belt-shaped base 21A, is a male seal bar 51 including a rectangular male base 51A, and a pair of linear male projections 51B provided on a side of the male base 51A and configured to form the male-side seal portions 21D. The pair of male projections 51B are configured to press both ends in the width direction of the male belt-shaped base 21A except for the portion corresponding to the engagement portion 23.

The other one of the pair of the seal bars as shown in FIG. 5B, which is configured to heat-seal the female belt-shaped base 22A, is a female seal bar 52 including a rectangular female base 52A, a female projection 52B provided on a side of the female base 52A and configured to form the first region 22D, and a pressing portion 52C.

The female projection 52B is configured to be in contact with a part of the female belt-shaped base 22A in the width direction provided with the easy-peel layer 22C2. Specifically, the female projection 52B includes linear portions 52B1 configured to form the first bonding portions 22D1, and pointed portions 52B2 (deformed portion), which are V-shaped in a plan view, and configured to form the second bonding portion 22D2. A length of each of the linear portions 52B1 located between the pointed portions 52B2 is as twice as large as a distance from a first edge of one of the side seals 12 to the second bonding portion 22D2 of the bag 1.

The pressing portion 52C is configured to be in contact with the female belt-shaped base 22A at a part opposite the part provided with the easy-peel layer 22C2 in the width direction, and to evenly apply pressure by the female projection 52B on the female belt-shaped base 22A on both sides of the engagement portion 23 when the female belt-shaped base 22A on is heat-sealed. Specifically, the pressing portion 52C has a linear shape parallel to the linear portion 52B1. The pressing portion 52C, which does not contribute to bonding of the female belt-shaped base 22A, is made of a heat-resistant resin (e.g. glass epoxy). It should be noted that the female seal bar 52 is not necessarily designed so that the pressing portion 52C is exclusively made of the heat-resistant resin, but may be designed as desired. For instance, a half of the female seal bar 52 (from a centerline of the female base 52A) provided with the pressing portion 52C may be made of a heat-resistant resin.

The female seal bar 52 is configured to form the first region 22D with a unit of the linear portions 52B1 and the pointed portions 52B2, more specifically, with one of the pointed portions 52B2 and halves of the linear portions 52B1 continuous with both ends of the one of the pointed portions 52B2. The first bonding portion 22D1 is formed when the linear portion 52B1 is in contact with the first portion S1 of the tight seal layer 22C1 of the female belt-shaped base 22A. The second bonding portion 22D2 is formed when the pointed portion 52B2 is in contact with the second portion S2 of the easy-peel layer 22C2.

In order to manufacture the bag 1 using the above-described machine, after a film feeding step for feeding the films 11A, 11B is performed, a tape feeding step for feeding the zipper tape 20, a tape attachment step for heat-sealing the male member 21 and the female member 22 onto the films 11A, 11B, respectively, and bag-making step for making a zipper tape bag from the films 11A, 11B are performed.

In the film feeding step, the films 11A, 11B are transferred to a downstream while being overlapped.

In the tape feeding step, the zipper tape 20 with the male portion 21B and the female portion 22B being engaged is fed into between the films 11A, 11B.

It should be noted that the male member 21 and the female member 22 are provided by an extrusion in advance in a form of the zipper tape 20 to be fed in the tape feeding step. The tight seal layer 22C1 and the easy-peel layer 22C2 are formed integrally with the female belt-shaped base 22A when the female member 22 is extruded.

In the tape attachment step, the seal bars as shown in FIGS. 5A and 5B are used.

The male member 21 and the female member 22 are heat-sealed to respective one of the films 11A, 11B.

At the time of the heat-sealing, two pairs of seal bars, which face each other with one of the films 11A, 11B and corresponding one of the male belt-shaped base 21A and the female belt-shaped base 22A disposed on an inner surface of one of the films 11A, 11B being interposed, are used. The seal bars are movable toward and away from each other. The male belt-shaped base 21A and the film 11A (11B), or the female belt-shaped base 22A and the film 11B (11A) are heat-sealed when the seal bars are moved toward each other.

When the female belt-shaped base 22A and the film 11B are bonded by the seal bars, the first portion S1 and the second portion S2 of the female belt-shaped base 22A are bonded to the film 11B to form the first region 22D.

In the bag-making step, a top seal bar is used to form the top seal 13 on the films 11A, 11B attached with the male member 21 and the female member 22 in the tape attachment step. Subsequently, a pair of the side seals 12 are formed using side seal bars to produce the bag body 10 attached with the zipper tape 20.

Then, the bag body 10 attached with the zipper tape 20 is subjected to a subsequent filling step, where the contents are put into the bag through an input opening (not shown) and the bottom seal 14 is formed on a periphery of the input opening to close the input opening. The bag 1 containing the contents is obtained by the filling step.

Use of Bag

Next, a usage of the bag 1 will be described with reference to the attached drawings. In the first exemplary embodiment, the usage of the bag 1 in which the contents (e.g. food) are contained in the housing space 100 in advance will be described below.

Figure 6:
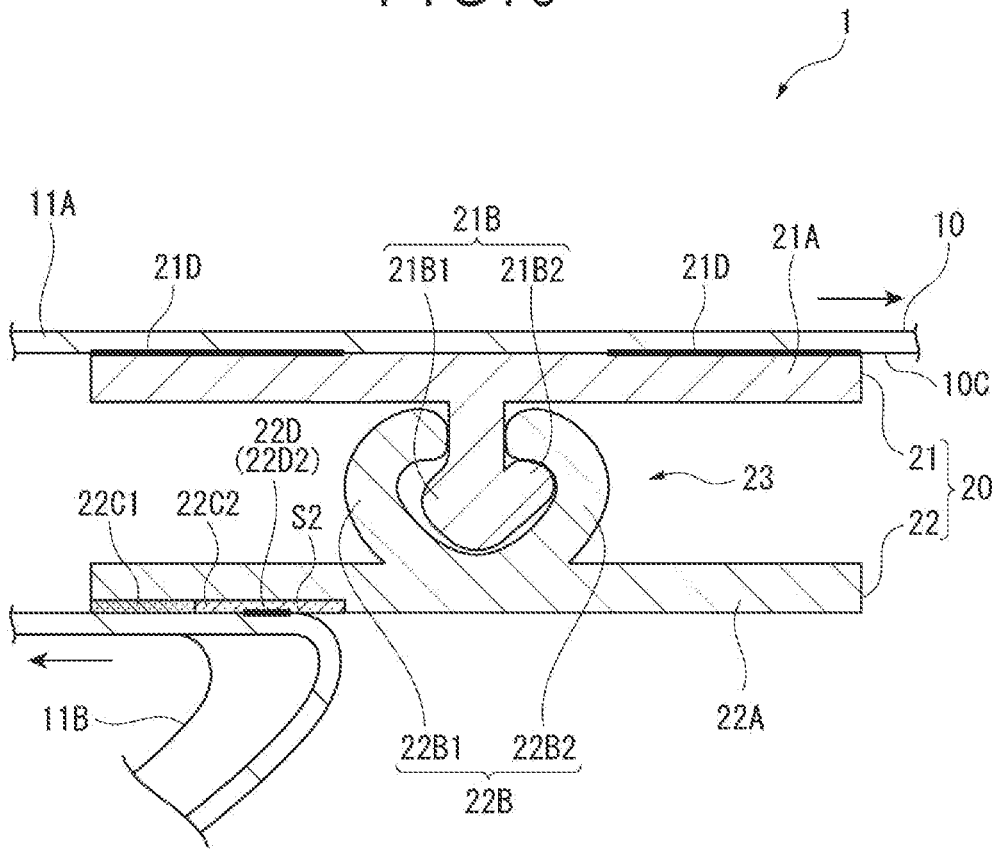
FIG. 6 is a cross sectional view showing how an internal pressure acts in the bag.
Figure 7A:
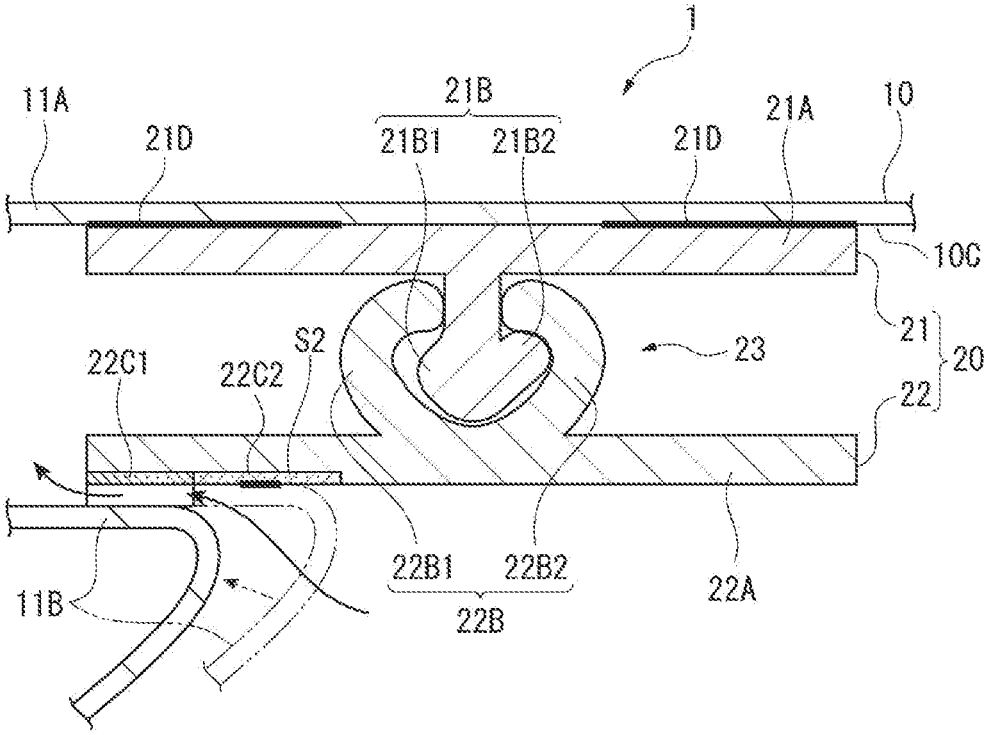
FIG. 7A is a cross sectional view at the center of the bag, showing how the internal pressure in the bag leaks.
Figure 7B:
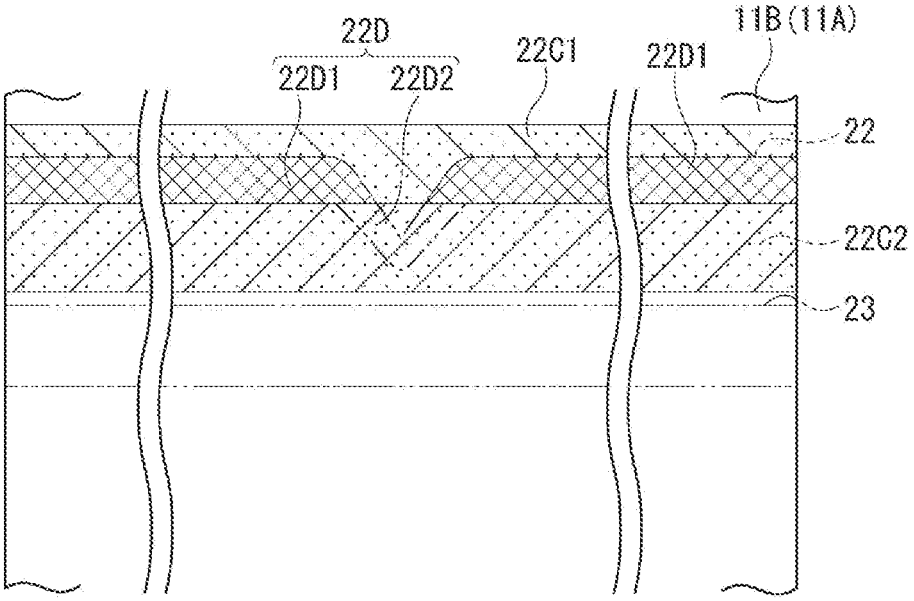
FIG. 7B is a plan view of a heat seal portion of the female member, showing how the internal pressure in the bag leaks.

FIG. 6 is a cross section showing how an internal pressure acts on the bag. FIGS. 7A and 7B show how the internal pressure of the bag leaks. FIG. 7A is a cross section of the second bonding portion 22D2. FIG. 7B is a plan view of the female member.

Initially, a user tears the films 11A, 11B from one of the notches 17 to remove the top seal 13. At this time, the male portion 21B and the female portion 22B are kept engaged so that the housing space 100 is hermetically sealed.

In this state, the contents are cooked by putting the bag in hot water, or in a microwave oven.

The internal pressure of the bag increases in the course of the cooking to expand the housing space 100 of the bag body 10. When the housing space 100 is expanded, since the female belt-shaped base 22A opposite the first region 22D is not bonded to the film 11B, forces act in directions for shearing the male belt-shaped base 21A and the female belt-shaped base 22A along the planes of the male belt-shaped base 21A and the female belt-shaped base 22A as shown by arrows in FIG. 6. The shearing forces cause the second male claw 21B2 and the second female claw 22B2, which have the hook-shaped cross sections, to be strongly engaged. Further, the internal pressure not only acts on the engagement portion 23 but a part of the internal pressure also acts between the female belt-shaped base 22A and the film 11B (11A).

When the internal pressure keeps increasing, the second bonding portion 22D2 of the first region 22D is peeled from the film 11B so that the internal pressure leaks through the peeled second bonding portion 22D2, as shown in FIGS. 7A and 7B. It should be noted that, even when the second bonding portion 22D2 is peeled to leak the internal pressure, the first bonding portion 22D1 having a large bonding strength is not peeled from the bag body 10.

As described above, since the internal pressure leaks through the second bonding portion 22D2, leakage of the contents caused by disengagement of the engagement portion 23 or bursting of the bag body 10 can be prevented.

The internal pressure applied during the cooking process can be adjusted by appropriately designing the width of the second bonding portion 22D2 (i.e. a dimension of the second bonding portion 22D2 along the longitudinal direction of the zipper tape 20), to allow various cooking including steaming.

After cooking, an opening periphery of the bag body 10 created by removing the top seal 13 is pinched and widened.

Thus, the first male claw 21B1 of the male portion 21B, which has a bulging cross section, moves to go over the first female claw 22B1 of the female member 22 to disengage the engagement portion 23 with a relatively small force, so that the housing space 10C easily becomes accessible to allow the contents to be taken out.

After the contents are taken out or put in, the bag body 10 is reclosable by engaging the male portion 21B and the female portion 22B again.

Advantage(s) of First Exemplary Embodiment

In the first exemplary embodiment, the zipper tape 20 including the easy-peel layer 22C2 at the predetermined position of the female belt-shaped base 22A is used. The easy-peel layer 22C2 of the female belt-shaped base 22A is disposed opposite the housing space 100 with respect to the engagement portion 23. The second bonding portion 22D2 is formed by bonding only the second portion S2 of the easy-peel layer 22C2 on the film 11B. Further, the first bonding portion 22D1 is formed by bonding the first portion S1 of the tight seal layer 22C1 on the film 11B.

Thus, the bonding strength of the second bonding portion 22D2 of the first region 22D can be easily made smaller than the bonding strength of the first bonding portion 22D1, so that only the second bonding portion 22D2 can be easily peeled from the film 11B with a simple structure.

Especially, when the internal pressure in the housing space 10C increases by cooking, the internal pressure can leak through the second bonding portion 22D2 selectively peeled from the film 11B. Accordingly, leakage of the contents due to inadvertent disengagement of the engagement portion 23 or bursting of the bag body 10 can be prevented by simply setting the portion to be heat-sealed without requiring a separate component.

Further, the belt-shaped configuration of the easy-peel layer 22C2 allows the position of the second bonding portion 22D2, and the to-be-easy-peeled region and location to be easily set. Accordingly, the bag can be designed to be suitable to a desired use, enhancing versatility thereof.

Since the first portion S1 and the second portion S2 are provided on the female belt-shaped base 22A of the female member 22, the female member 22 is more rigid than an instance in which the first portion S1 and the second portion S2 are provided on the male member 21. Accordingly, the bag 1 capable of achieving the above advantages can be easily produced.

The first portion S1 of the female belt-shaped base 22A is made of polypropylene and the second portion S2 is made of the mixture layer of polyethylene and polypropylene. Accordingly, when the films 11A, 11B are made of polypropylene, the bonding strength between the first portion S1 and the film 11B can be increased, so that the bonding strength between the second portion S2 and the film 11B can be made lower than the bonding strength between the first portion S1 and the film 11B. Thus, when the internal pressure acts in the housing space 10C, only the second bonding portion 22D2 (bonding portion of the second portion S2 and the film 11B) detaches from the film 11B.

The male portion 21B of the zipper tape 20 includes the first male claw 21B1 having the bulging cross section and the second male claw 21B2 having the hook-shaped cross section.

Thus, the claws strongly engages in response to an increase in the internal pressure to prevent the leakage of the content, while allowing to be easily disengaged with a small force in opening the bag. As described above, the force required for disengagement is different depending on the direction for disengaging the engagement portion 23, specifically, depending on whether the engagement portion 23 to be disengaged from the opening created by opening the bag, or from the housing space 10C. Accordingly, a disengagement function suitable to a desired use can be provided, enhancing versatility thereof.

Further, the second bonding portion 22D2 is provided at the center of the female member 22 in the longitudinal direction.

Accordingly, when the bag body 10 is expanded due to an increase in the internal pressure of the housing space 10C, the second bonding portion 22D2 can be peeled from the film 11B at a position vertically above the housing space 10C. Specifically, when the bag is put in hot water with the bottom seal 14 being at the bottom, or put in a microwave oven for cooking with the bag body 10 being laid on the film 11A, the second bonding portion 22D2 is located vertically above the contents contained in the housing space 10C. Accordingly, the leakage of the contents through the second bonding portion 22D2 can be prevented.

In the above arrangement, it is preferable to provide a mark or the like on the bag body 10 so that a user can recognize the part to be placed at the bottom during cooking.

It should be noted that the second bonding portion 22D2 is not necessarily provided at the center of the female member 22 in the first exemplary embodiment.

Further, the second bonding portion 22D2 has a pointed end directed to the engagement portion 23.

Accordingly, the bonding strength can be easily weakened at the engagement portion 23. Thus, when the internal pressure in the housing space 100 increases, the second bonding portion 22D2 can be easily and selectively peeled from the engagement portion 23, thereby appropriately leaking the internal pressure. Further, the second bonding portion 22D2 is tapered toward the front end. Accordingly, the bonding strength at the second bonding portion 22D2 can be easily weakened toward the engagement portion 23.

Since the second bonding portion 22D2 is continuous with the first bonding portions 22D1, liquid-tightness can be ensured before the second bonding portion 22D2 is detached, thereby preventing leakage of the contents even when the contents include liquid substance.

An internal pressure suitable for cooking (e.g. steaming) can be secured by adjusting the width of the second bonding portion 22D2. In other words, the pressure to be leaked can be adjusted depending on the content, thereby improving versatility.

The female seal bar 52 including an alternate series of the linear portions 52B1 and the pointed portions 52B2 is used to bond the film 11B with the first portion S1 and the second portion S2 to form the first region 22D.

Accordingly, the first region 22D capable of being selectively detached at the bonded portion of the second portion S2 and the film 11B can be easily formed.

Second Exemplary Embodiment

Next, a second exemplary embodiment of the invention will be described with reference to FIGS. 8 to 10. It should be noted that, in the second exemplary embodiment and modifications, the components identical to those in the first exemplary embodiment are denoted by the same reference signs and the explanation thereof will be omitted or simplified.

The second exemplary embodiment is the same as the first exemplary embodiment except for the structure of the bag body 10 and the structure of the zipper tape 20 with enhanced liquid-tightness.

Figure 8:
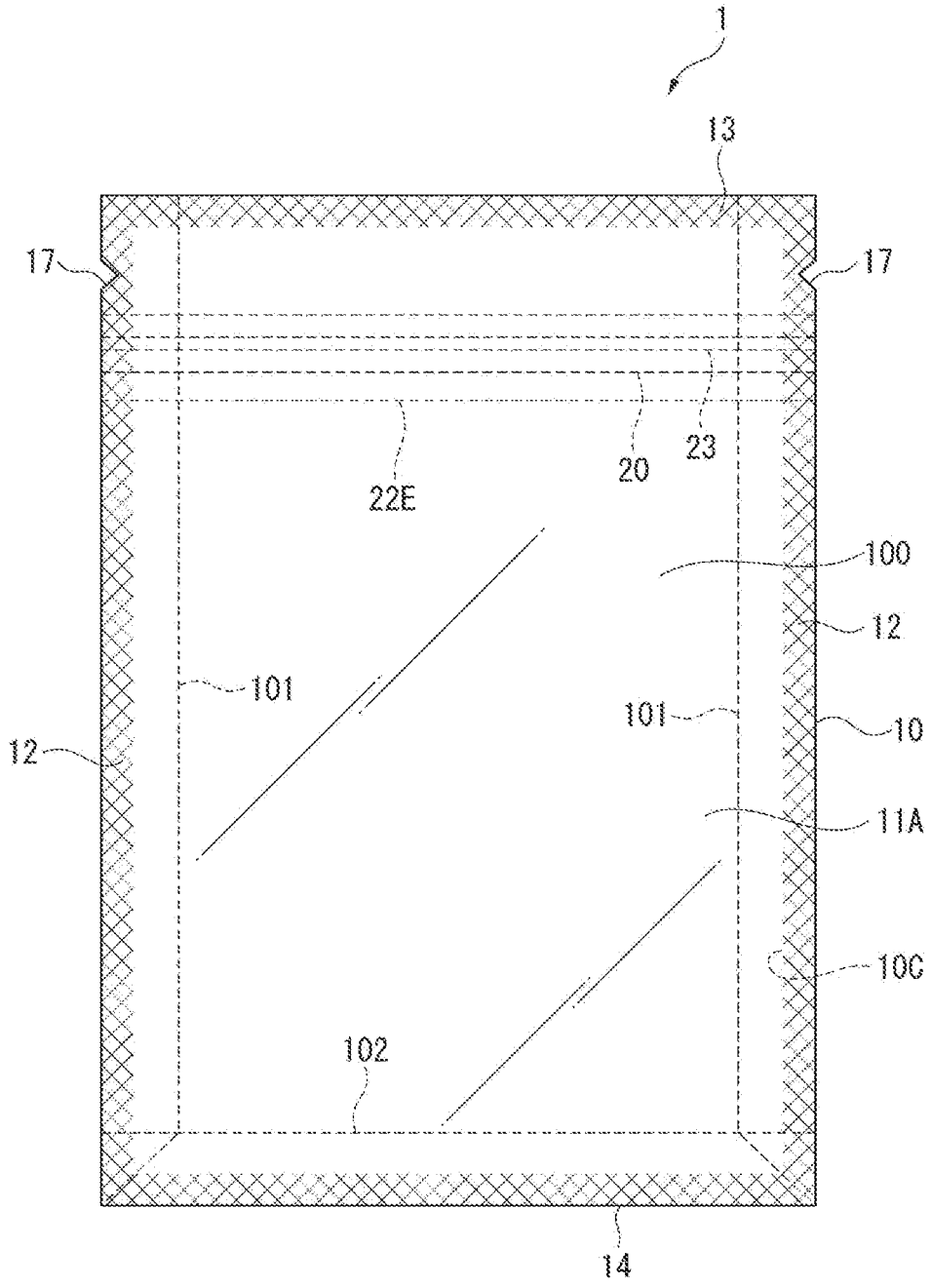
FIG. 8 is a plan view showing a bag according to a second exemplary embodiment of the invention.

FIG. 8 is a plan view of the bag 1. FIG. 9 is a cross section of a relevant part of the bag 1.

Figure 9:
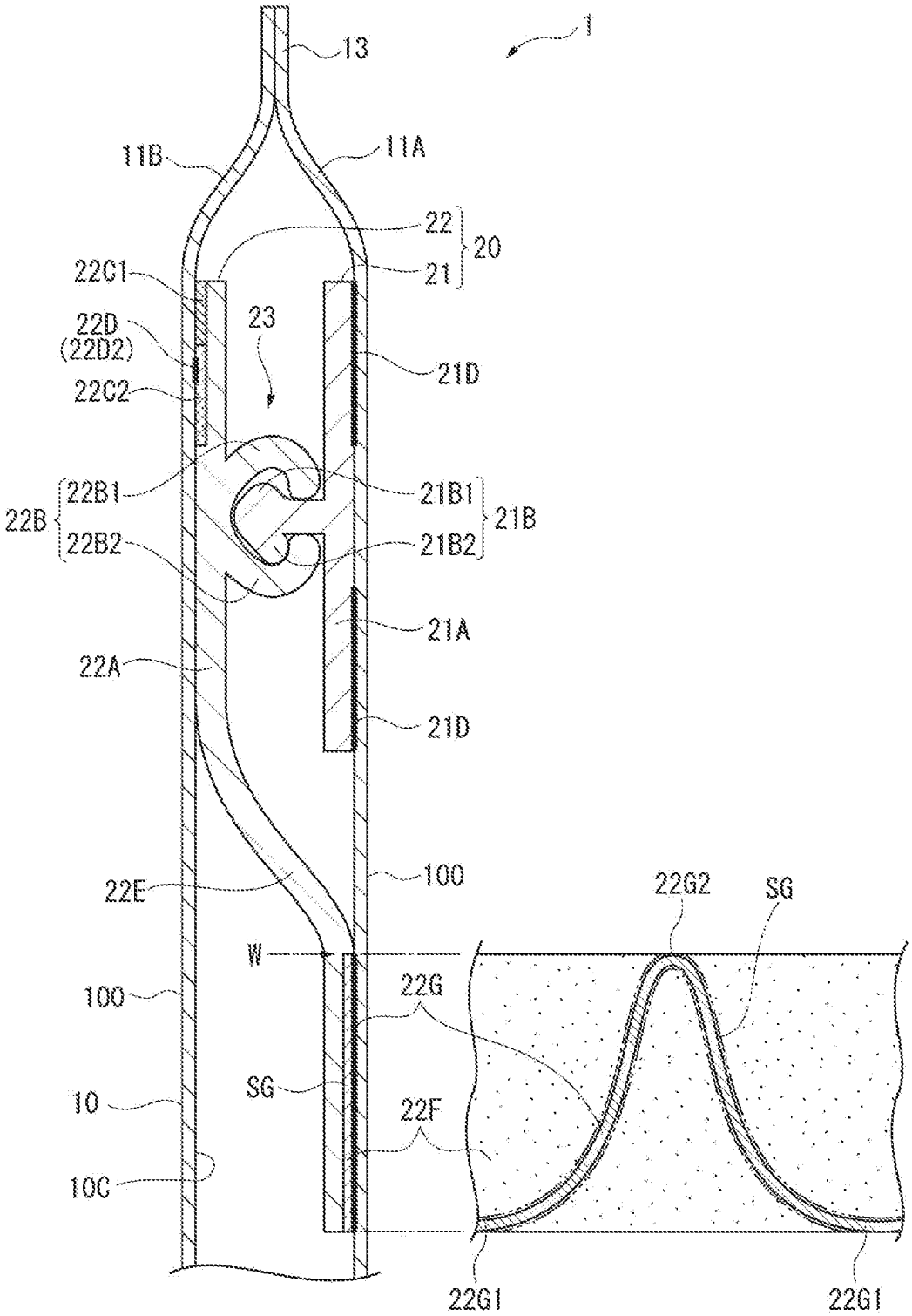
FIG. 9 is a cross sectional view showing a relevant part of the bag according to the second exemplary embodiment.

As shown in FIGS. 8 and 9, the bag 1 according to the second exemplary embodiment includes the bag body 10 in a form of a gusset bag and the zipper tape 20 attached to the bag body 10.

The bag body 10 includes a pair of flat portions 100 that face each other, a pair of lateral portions 101 that are interposed between the flat portions 100 at lateral peripheries of the bag body 10, and a bottom portion 102. The lateral portions 101 and the bottom portion 102 are each interfolded along a bend line. It should be noted that the lateral portions 101 and the bottom portion 102 are not illustrated in FIG. 10.

The zipper tape 20 includes the male member 21 and the female member 22. The female belt-shaped base 22A of the female member 22 includes an extension 22E extended opposite the easy-peel layer 22C2 with respect to the engagement portion 23 (i.e. toward the housing space 100 beyond an edge of the male belt-shaped base 21A).

The extension 22E is formed along a width direction of the female belt-shaped base 22A. The extension 22E is bonded to the male belt-shaped base 21A and the bag body 10.

The extension 22E is provided with a second easy-peel layer 22F, which is shaped in a form of a belt along the longitudinal direction of the female belt-shaped base 22A, in an extended region beyond the edge of the male belt-shaped base 21A. A part of the second easy-peel layer 22F defines a sealable portion SG bondable to the film 11A. The sealable portion SG is bondable to the film 11A with a bonding strength smaller than the bonding strength between the first portion S1 of the female belt-shaped base 22A and the film 11B. The bonding strength of the sealable portion SG is set so that the extension 22E is detachable from the film 11A when a user disengages the engagement portion 23 to open the bag.

The second easy-peel layer 22F is provided in a region from a point W to an edge of the extension 22E near the housing space 10C, the point W being defined at a position at which a distance from the engagement portion 23 on the female belt-shaped base 22A to the point W is longer than a distance from the engagement portion 23 to an edge of the male belt-shaped base 21A.

The male member 21 of the zipper tape 20 is bonded to the film 11A at the male-side seal portions 21D. Further, the sealable portion SG on the extension 22E of the female member 22 is bonded to the film 11A to form a second region 22G.

In the sealable portion SG, the bonded portion of the film 11A and the extension 22E is wave-shaped along the longitudinal direction of the female belt-shaped base 22A.

The bonding strength of the sealable portion SG to the film 11A can be easily adjusted by changing the shape of the sealable portion SG (e.g. the waveform of the wave-shaped profile). Specifically, as shown in FIG. 9, the sealable portion SG capable of forming the second region 22G is bonded to the film 11A in a wave-shaped configuration, where a curvature radius of a waveform 22G1 near the housing space 10C is larger than a curvature radius of a waveform 22G2 near the engagement portion 23. According to the above arrangement, the sealable portion SG is not easily peeled from the film 11A at the waveform 22G2 with the large curvature radius and is easily peeled from the film 11A at the waveform 22G2 with the small curvature radius. Thus, the sealable portion SG is not easily peeled from the film 11A by the internal pressure applied from the housing space 100, and the sealable portion SG can be easily peeled from the film 11A with a relatively small force when a user peels the sealable portion SG from the film 11A simultaneously with disengaging the engagement portion 23.

It should be noted that the wave-shaped profile may be symmetrical (e.g. sinewave). Further, the sealable portion SG is not necessarily wave-shaped, but may have various shapes (e.g. linear, slanted, and saw-tooth) as long as being capable of bonding to the film 11A to form the second region 22G.

When the internal pressure in the bag 1 increases, the second bonding portion 22D2 is peeled from the film 11B to leak the internal pressure in the same manner as the first exemplary embodiment shown in FIGS. 1 to 7. At this time, the second region 22G is not peeled from the film 11A. Thus, the engagement portion 23 is kept being isolated from the housing space 100 by the extension 22E. Accordingly, the leakage of the contents through the engagement portion 23 can be prevented when the internal pressure increases.

Next, an example of the usage of the bag 1 according to the second exemplary embodiment will be described below with reference to FIG. 10.

An example of a cooking process using the bag 1 according to the second exemplary embodiment will be described.

Figure 10:
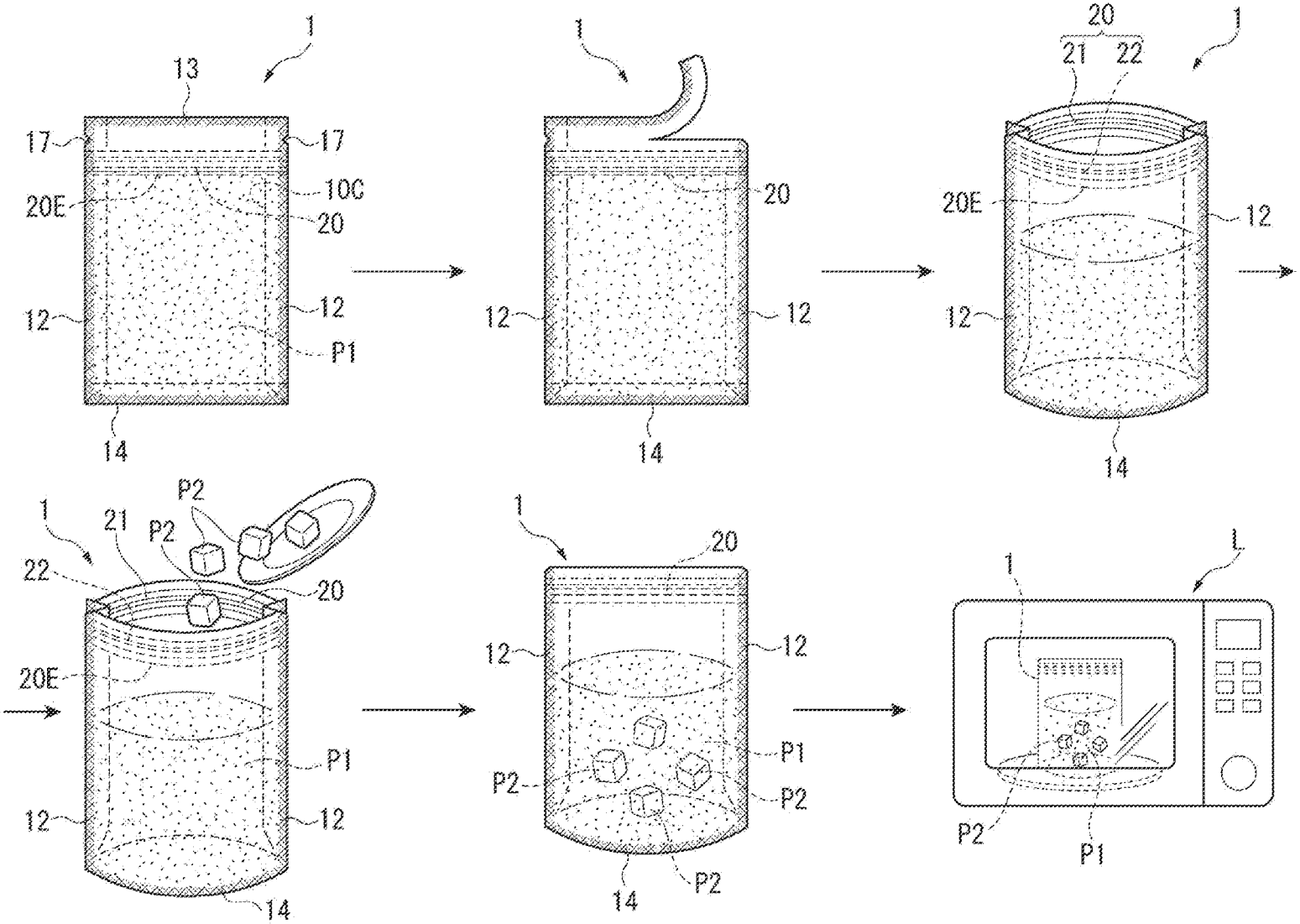
FIG. 10 illustrates a cooking process using the bag according to the second exemplary embodiment.

As shown in FIG. 10, a user prepares the bag 1, in which contents (fluid food P1 such as soup, and sauce for bean curd Szechuan style) are contained in advance in the housing space 100 thereof. The food P1 may be subjected to a retort sterilization treatment after being put into the bag body 10. Then, the bag body 10 is cut from one of the notches 17 to form an opening. When the opening periphery of the bag body 10 is pinched and widened by both hands, the male member 21 and the female member 22 are disengaged. Subsequently, the opening periphery of the bag body 10 is further widened to peel the second region 22G from the film 11A to bring the housing space 10C to be accessible from an outside.

When the housing space 100 becomes accessible, separately prepared additional contents (food P2 such as ingredients of soup, and tofu) are put into the housing space 100 through the opening of the bag body 10. The bag 1 housing the foods P1, P2 in the housing space 10C thereof is put in a microwave oven L to cook the foods. At this time, the bag 1 is placed upright on a turntable of the microwave oven L.

Internal pressure, which sometimes acts in the bag 1 heated in the microwave oven L, leaks as in the first exemplary embodiment.

The manufacturing machine and the manufacturing method of the bag according to the second exemplary embodiment are the same as those in the first exemplary embodiment except for an additional component for bonding the extension 22E onto the film 11A.

According to the third exemplary embodiment, in addition to the advantages of the first exemplary embodiment, the housing space 100 is highly liquid-tight by the second region 22G on the extension 22E before the internal pressure leaks.

Further, since the sealable portion SG is bonded to the bag body 10 to provide a wave-shaped bonded region along the longitudinal direction of the female belt-shaped base 22A, the peeling force concentrates at the portion to be peeled. Accordingly, the sealable portion SG can be peeled from the bag body 10 with a relatively small force as compared with a linear sealable portion.

The bag body 10 is a gusset bag. Accordingly, the bag 1 can be placed upright on the turntable of the microwave oven L with the foods P1, P2 (content) being contained in the housing space 100. Thus, it is expectable that leakage of the contents can be reduced as compared with an instance in which the bag 1 is laterally laid when the internal pressure leaks.

It should be noted that the bag body 10 placed upright on a turntable in the second exemplary embodiment is not necessarily a gusset bag, but may be a bag of a different structure (e.g. a bag having a facing pair of flat portions, and a bottom portion).

Third Exemplary Embodiment

Next, a third exemplary embodiment of the invention will be described with reference to FIG. 11.

The third exemplary embodiment is the same as the second exemplary embodiment except for the structure of the extension 22E.

Figure 11:
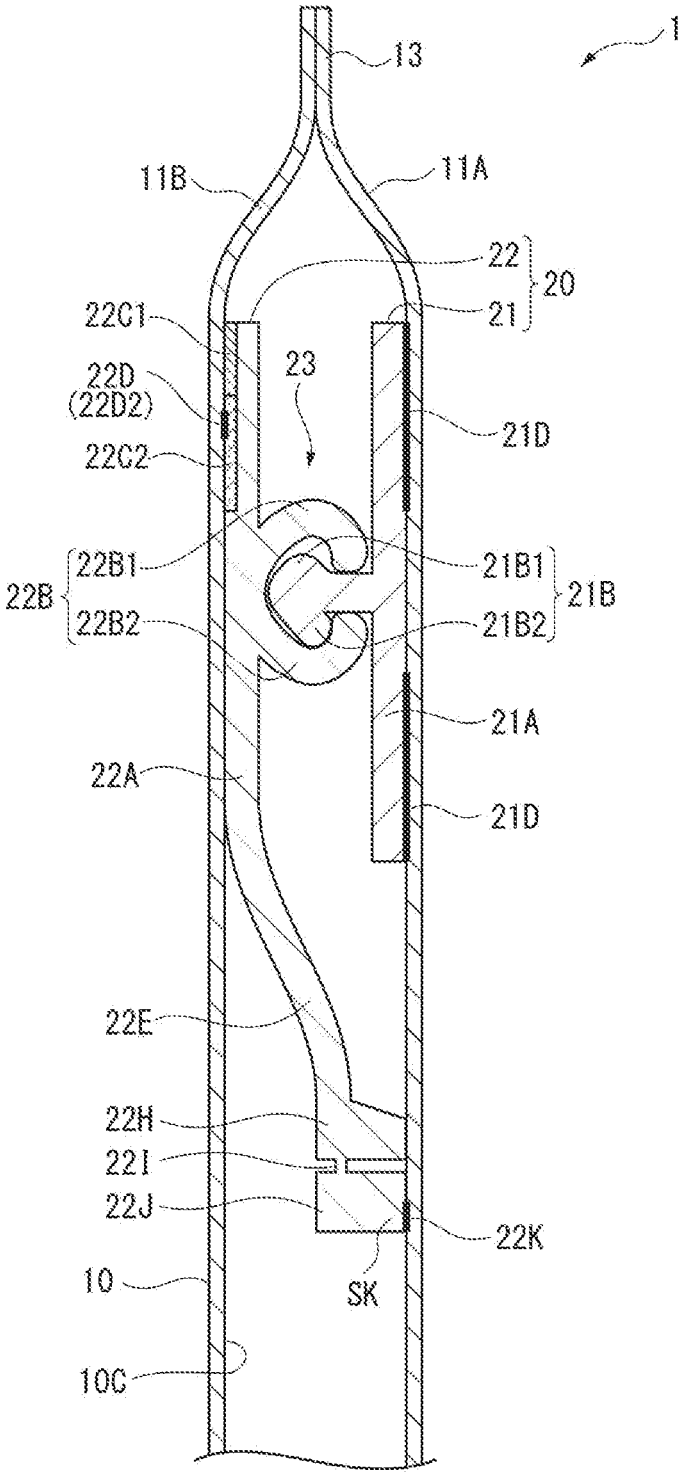
FIG. 11 is a cross sectional view showing a relevant part of a bag according to a third exemplary embodiment of the invention.

As shown in FIG. 11, the zipper tape 20 according to the third exemplary embodiment includes the extension 22E. The extension 22E includes a first thick portion 22H thicker than the female belt-shaped base 22A, a thin portion 22I connected to the first thick portion 22H and thinner than the female belt-shaped base 22A, and a second thick portion 22J connected to the thin portion 22I and thicker than the female belt-shaped base 22A. The second thick portion 22J is disposed near the housing space 10C.

In the third exemplary embodiment, the thin portion 22I defines a cut portion at which the extension 22E is cut. The thin portion 22I has such strength that the thin portion 22I is not torn by an increase in the internal pressure but is tearable when a user disengages the engagement portion 23 to open the bag. It should be noted that the cut portion is not necessarily provided by the thin portion 22I, but may have any structure capable of being torn between the first thick portion 22H and the second thick portion 22J. For instance, the cut portion may be formed by perforations in a recess capable of continuously cutting, or may be formed of a soft material capable of being cut. In terms, especially, of liquid-tightness, it is preferable that the cut portion has a structure (e.g. thin portion) that reliably isolates the housing space 10C.

The second thick portion 22J includes a bondable region SK capable of being bonded to the film 11A. The bondable region SK is bonded to the film 11A to form a bonding region 22K.

The male member 21 of the zipper tape 20 is bonded to the film 11A at the male-side seal portions 21D. Further, the bonding region 22K of the extension 22E of the female member 22 is bonded to the film 11A.

The bonding strength between the bondable region SK of the extension 22E and the film 11A is greater than the bonding strength between the second portion S2 of the female belt-shaped base 22A and the film 11B, so that the bondable region SK is not peeled from the film 11A by an increase in the internal pressure.

When the internal pressure in the bag 1 of the third exemplary embodiment increases, the second bonding portion 22D2 is peeled to leak the internal pressure in the same manner as the first and second exemplary embodiments. At this time, the bonding region 22K is not peeled and the thin portion 22I is not torn. Thus, the engagement portion 23 is kept being isolated from the housing space 100 by the extension 22E. Accordingly, when the contents include liquid substance, the housing space 10C is highly liquid-tight until the second bonding portion 22D2 is peeled to leak the internal pressure.

In contrast, when a user opens the bag, the user disengages the engagement portion 23 and widens the gap between the films 11A, 11B to cut the thin portion 22I, thereby bringing the housing space 10C to be accessible.

Fourth Exemplary Embodiment

Next, a fourth exemplary embodiment of the invention will be described with reference to FIGS. 12A to 12B.

The fourth exemplary embodiment is the same as the first exemplary embodiment except for the structure of the zipper tape 20.

Figure 12A:
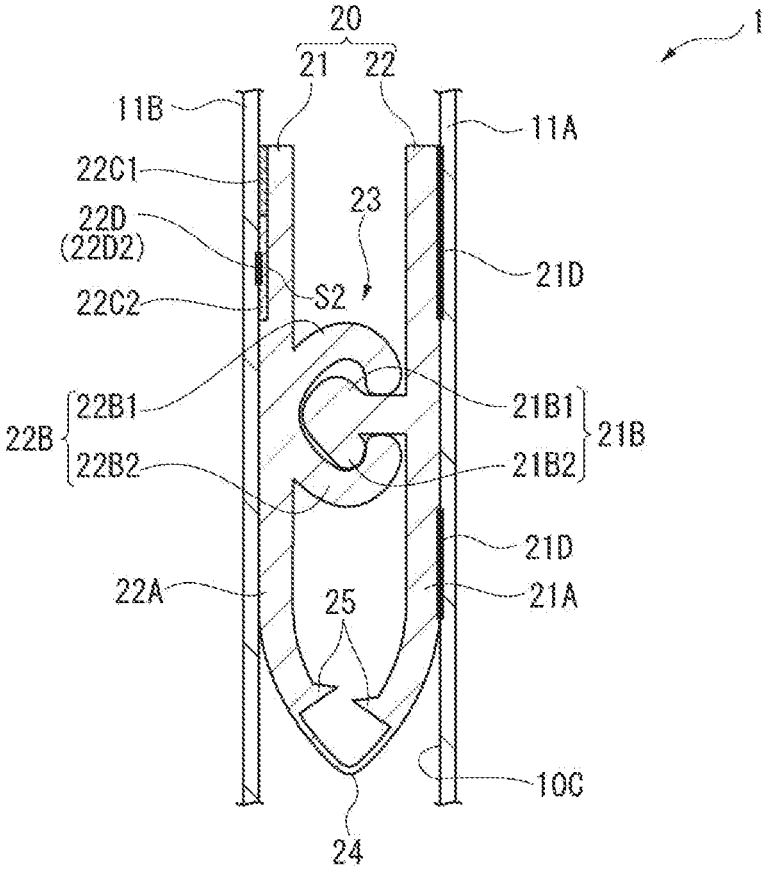
FIG. 12A is a cross sectional view showing a relevant part of a bag according to a fourth exemplary embodiment of the invention.

FIG. 12A shows a cross section of a relevant part of the bag 1.

As shown in FIG. 12A, the zipper tape 20 of the fourth exemplary embodiment includes the male member 21, the female member 22 and a connecting portion 24. The connecting portion 24 connects an end of the male belt-shaped base 21A of the male member 21 and an end of the female belt-shaped base 22A of the female member 22 near the housing space 10C in the width direction orthogonal to the longitudinal direction. In other words, the connecting portion 24 is disposed along the longitudinal direction of the male belt-shaped base 21A and the female belt-shaped base 22A at a side opposite the side provided with the first region 22D with respect to the engagement portion 23.

Projections 25 are provided along the longitudinal direction of the connecting portion 24 at respective regions between the male belt-shaped base 21A and the connecting portion 24 and between the female belt-shaped base 22A and the connecting portion 24. The projections 25 are disposed so that ends of the projections 25 face each other.

Figure 12B:
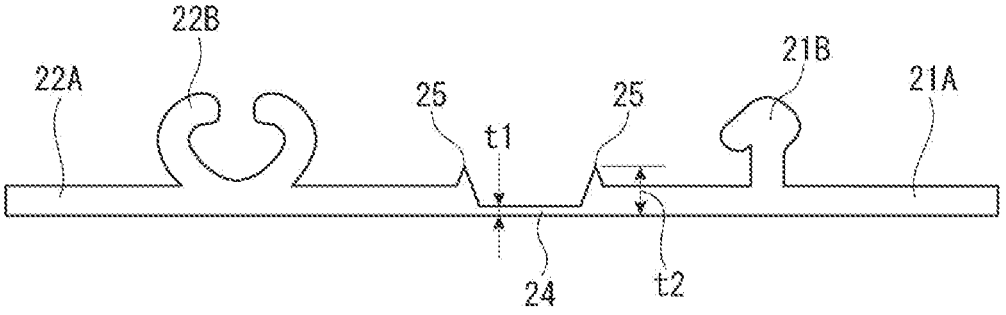
FIG. 12B is an illustration showing an unfolded zipper tape according to the fourth exemplary embodiment.

FIG. 12B shows the zipper tape 20 being unfolded.

A thickness t1 of the connecting portion 24 in FIG. 12B is in a range from 10 μm to 100 μm, preferably in a range from 20 μm to 80 μm, more preferably in a range from 20 μm to 50 μm, further preferably in a range from 30 μm to 50 μm. When the thickness t1 is less than 10 μm, the connecting portion 24 can be easily cut, however, the connecting portion 24 may be damaged due to abrasion or due to insufficient strength in putting the content. When the thickness t1 is greater than 100 μm, the strength of the connecting portion 24 is too large to be easily cut.

A thickness t2 of each of the projections 25 is in a range from 200 μm to 2 mm, preferably in a range from 300 μm to 105 mm, more preferably in a range from 300 μm to 1 mm. The projections 25 are provided in order to allow stress to be easily concentrated at the connecting portion 24. Without the projections 25, the borders between the connecting portion 24 and the male belt-shaped base 21A/female belt-shaped base 22A become obscure, so that the connecting portion 24 cannot be easily cut.

The thickness of each of the male belt-shaped base 21A and the female belt-shaped base 22A is between the thickness t1 of the connecting portion 24 and the thickness t2 of the projections 25 (e.g. 150 μm).

The usage, manufacturing method and manufacturing machine of the bag 1 according to the fourth exemplary embodiment are the same as those in the first exemplary embodiment.

Since the male belt-shaped base 21A and the female belt-shaped base 22A are connected via the connecting portion 24 in the fourth exemplary embodiment, even highly fluid contents can be prevented from flowing out. In addition, the contents can be easily taken out by cutting the connecting portion 24.

The projections 25 provided between the male belt-shaped base 21A/female belt-shaped base 22A and the connecting portion 24 allow the connecting portion 24 to be easily cut.

Fifth Exemplary Embodiment

A fifth exemplary embodiment of the invention will be described with reference to FIG. 1.

While the top seal 13 is provided to the bag 1 in FIG. 1, the top seal 13 is not provided to the bag 1 of the fifth exemplary embodiment.

Specifically, the bag body 10 is provided with the side seals 12 and the bottom seal 14. A part of the bag body 10 opposite the bottom seal 14 with respect to the zipper tape 20 (i.e. a part corresponding to the top seal 13) is left opened.

According to the fifth exemplary embodiment, the male portion 21B and the female portion 22B are disengaged to bring the housing space 10C to be accessible from the outside prior to cooking. After a user puts contents (e.g. food), which are prepared in advance, into the housing space 10C, the bag is subjected to microwave cooking with the zipper tape 20 being closed.

Since the peripheral end of the bag body 10 opposite the housing space 100 across the zipper tape 20 is not bonded in the fifth exemplary embodiment, the bag can be used as a cooking tool for a user to cook a favorite food.

Modifications

It should be noted that, though the best arrangement and the like for implementing the invention is disclosed in the above, the scope of the invention is not limited thereto. In other words, while the invention has been particularly explained mainly in relation to specific exemplary embodiments, a person skilled in the art could make various modifications in terms of material, quantity or other particulars to the above described exemplary embodiment without deviating from the technical idea or any object of the invention.

In the invention, it is not necessary that the internal pressure increases in the course of cooking to leak the internal pressure by peeling the second bonding portion 22D2. For instance, in some embodiments, the internal pressure increases in response to a pressing force applied from an outside, or relatively increases due to fall in the outside atmospheric pressure.

Figure 13:
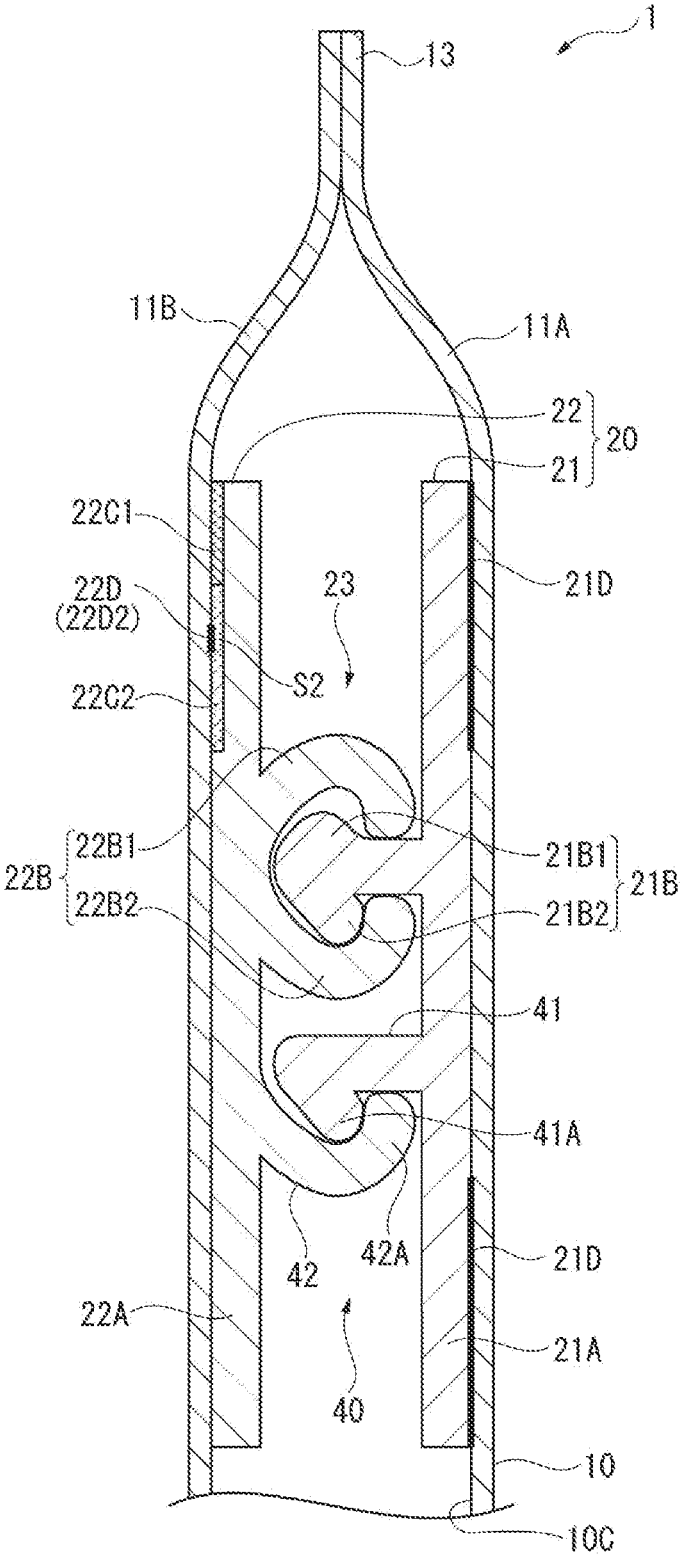
FIG. 13 is a cross sectional view showing a relevant part of a bag according to a modification of the invention.

In some embodiments of the invention, a plurality of (e.g. two) engagement portions 23 are provided as shown in FIG. 13.

The zipper tape 20 shown in FIG. 13 includes a second engagement portion 40 disposed close to the housing space 100 in parallel to the engagement portion 23. The second engagement portion 40 includes a male hook 41 parallel to the male portion 21B, and a female hook 42 parallel to the female portion 22B. The male hook 41 includes a third male claw 41A projecting toward the housing space 10C. The female hook 42 includes a third female claw 42A engageable with the third male claw 41A. According to the above arrangement, the engagement strength can be enhanced by the engagement at the plurality of portions (i.e. the engagement portion 23 and the second engagement portion 40), thereby providing a high sealability.

It should be noted that although the plurality of pairs of engagement portions 23 in FIG. 13 are provided by the engagement portions 23, 40 with different structures, a plurality of engagement portions 23 with the same structure are provided in some other embodiments.

Though the second bonding portion 22D2 is provided at the center in the above exemplary embodiments, the second bonding portion 22D2 is placeable at any intermediate position between the side seals 12 except for both ends of the zipper tape 20 overlapping the side seals 12.

Further, the second portion S2, which is bonded to the film 11B to form the second bonding portion 22D2, is provided at a plurality of parts in some embodiments. When the second portion S2 is provided at a plurality of parts, the internal pressure can leak through the plurality of parts in response to an increase in the internal pressure in the housing space 10C. Accordingly, inadvertent disengagement of the engagement portion 23 and bursting of the bag body 10 can be prevented, and the internal pressure can be set at an appropriate level suitable for the content.

The second bonding portion 22D2 is not necessarily continuous with the first bonding portion 22D1. For instance, the second bonding portion 22D2 is discontinuous in some embodiments as shown in FIG. 14.

Figure 14:
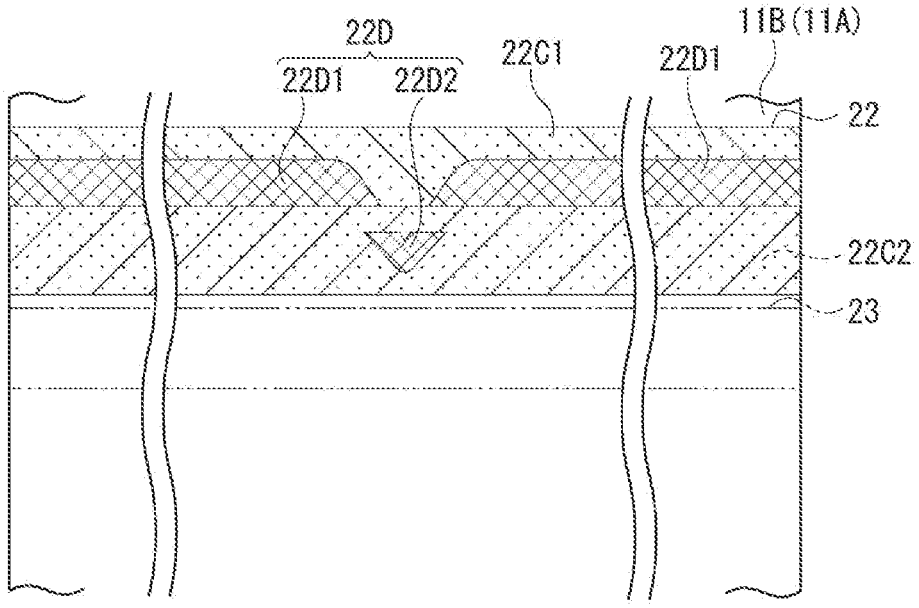
FIG. 14 is a plan view showing a relevant part of a bag according to another modification of the invention.

In the embodiment shown in FIG. 14, the internal pressure leaks through the discontinuous portion until the internal pressure reaches a predetermined level. When the internal pressure exceeds the predetermined level, the second bonding portion 22D2 is peeled from the film 11B to increase the pressure leakage.

Though the first bonding portion 22D1 is formed by applying the female seal bar 52 only on the tight seal layer 22C1 in the above exemplary embodiments, the female seal bar 52 is also applied to the easy-peel layer 22C2 in some embodiment of the invention.

Figure 15:
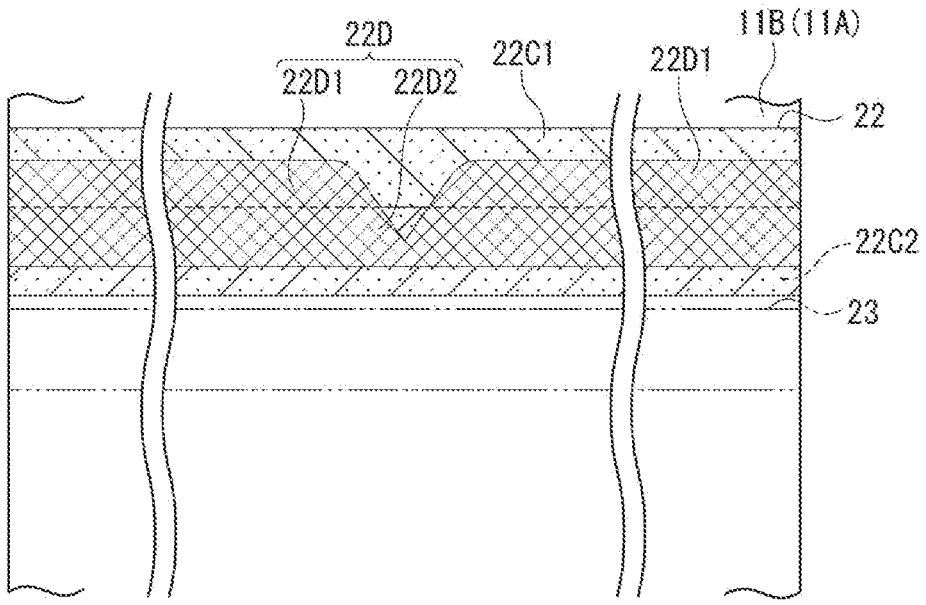
FIG. 15 is a plan view showing a relevant part of a bag according to still another modification of the invention.

In other words, the first bonding portion 22D1 crosses the tight seal layer 22C1 and the easy-peel layer 22C2, and has a linear side edge overlapping the easy-peel layer 22C2, in some embodiment shown in FIG. 15.

Figure 16:
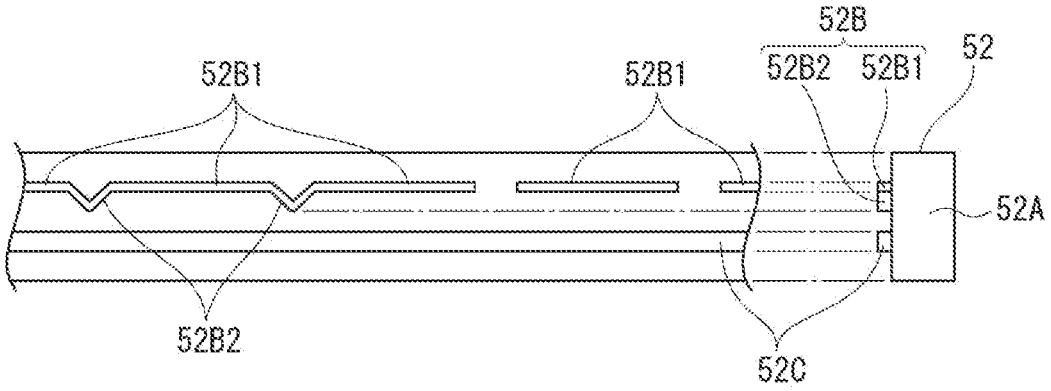
FIG. 16 illustrates a female seal bar according to an embodiment of the invention.
Figure 17A:
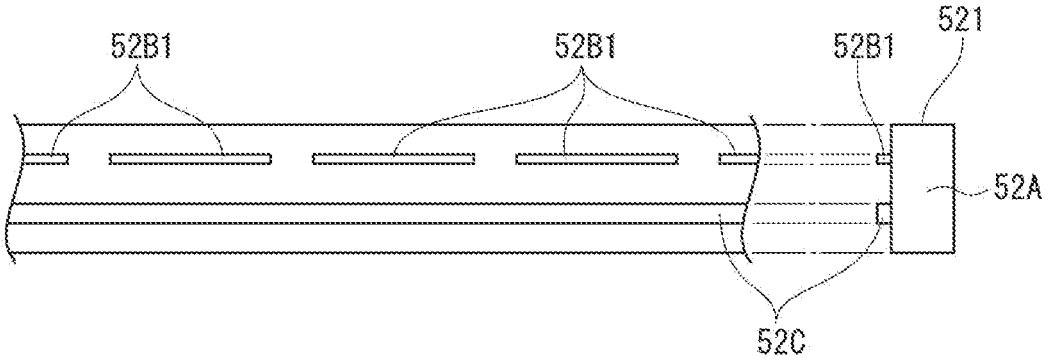
FIG. 17A illustrates a first seal bar of a female seal bar according to another embodiment of the invention.
Figure 17B:
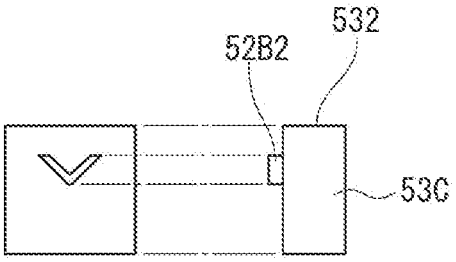
FIG. 17B illustrates a second seal bar of the female seal bar according to the another embodiment of the invention.

The female seal bar 52 for forming the first bonding portion 22D1 and the second bonding portion 22D2 is configured as shown in FIG. 16 or as shown in FIGS. 17A and 17B depending on the manufacturing machine and the manufacturing method in some embodiments.

The female seal bar 52 shown in FIG. 16 includes the rectangular female base 52A, the female projection 52B provided on a side of the female base 52A and configured to press an edge of the female belt-shaped base 22A to form the first region 22D, and the pressing portion 52C made of a heat-resistant resin. The female projection 52B includes the linear portions 52B1 configured to form the first bonding portions 22D1, and the pointed portions 52B2, whose profiles are V-shaped in a plan view, configured to form the second bonding portion 22D2. The linear portions 52B1 are spaced apart from each other at a predetermined interval, which specifically corresponds to the width of the second bonding portion 22D2. The pointed portions 52B2 are provided between and continuously with the linear portions 52B1. It should be noted that the pointed portions 52B2 are provided so that a region of a predetermined number (e.g. three) of the linear portions 52B1 connected by the pointed portions 52B2 and a region defined by the predetermined number (three) of discontinuous linear portions 52B1 are alternately provided. It should be noted that the linear portions 52B1, which are preferably pressed a plurality of times to seal the same points in order to enhance the bonding strength of the first bonding portion 22D1, are preferably provided at predetermined intervals.

The female seal bar 52 shown in FIG. 16 is configured to simultaneously bond the first region 22D for three bags 1 with the series of the three linear portions 52B1 and the three pointed portions 52B2.

The example shown in FIG. 16, which can simultaneously form a plurality of the first regions 22D, can enhance the production speed.

In another embodiment, the female seal bar 52 includes a first seal bar 521 shown in FIG. 17A and a second seal bar 532 shown in FIG. 17B.

The first seal bar 521 includes: the rectangular female base 52A; the linear portions 52B1 provided on a side of the female base 52A at predetermined intervals corresponding to the width of the second bonding portion 22D2 and configured to form the first bonding portions 22D; and the pressing portion 52C made of a heat-resistant resin.

The second seal bar 532 includes the rectangular female base 52A, and the pointed portion 52B2 solely provided on a side of the female base 52A.

The female seal bar 52 shown in FIGS. 17A and 17B are configured to form the first bonding portions 22D1 for a plurality of bags 1 using the first seal bar 521 and position the second seal bar 532 between adjacent ones of the first bonding portions 22D1 to form the second bonding portion 22D2.

According to the embodiment shown in FIGS. 17A and 17B, the seal bar can be easily formed with the use of the first seal bar 521 for the first bonding portion 22D1 and the second seal bar 532 for the second bonding portion 22D2.

Further, the zipper tape 20 is provided with a low-melting-point layer, whose melting point is lower than the melting points of the male belt-shaped base 21A and the female belt-shaped base 22A, to stabilize the effect of a so-called cantilever configuration in some embodiments.

Figure 18:
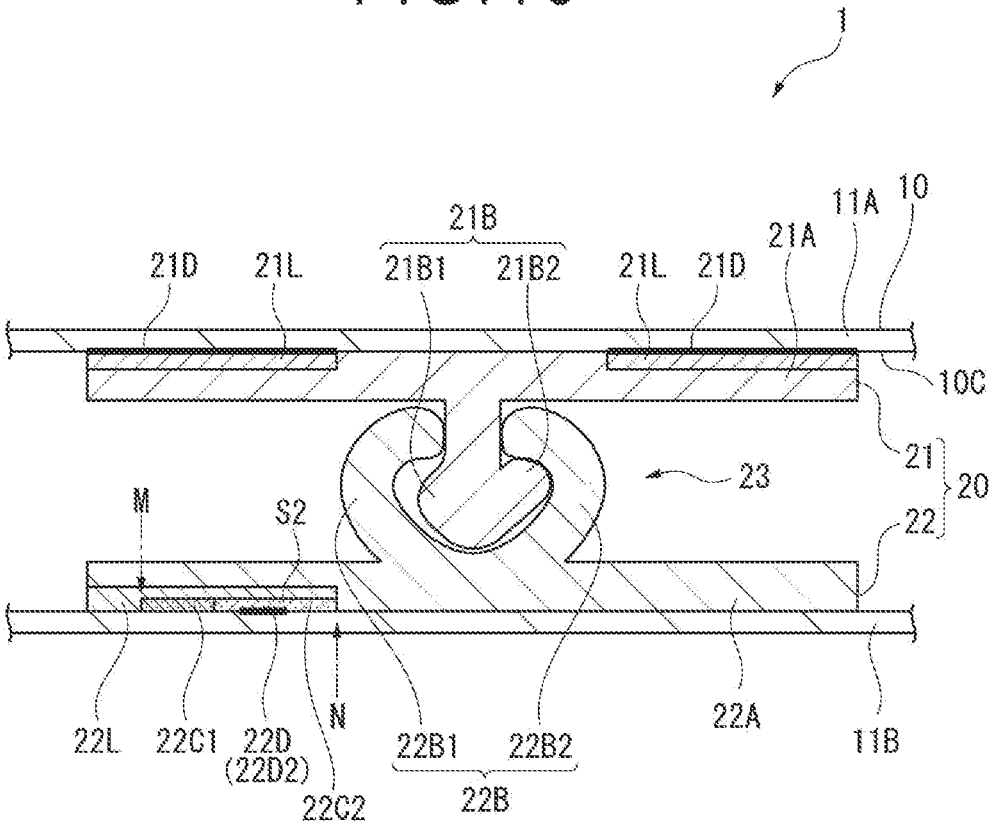
FIG. 18 is a cross sectional view showing a part of a bag according to still another embodiment of the invention.

Specifically, as shown in FIG. 18, a side of the male belt-shaped base 21A opposite the side having the engagement portion 23 is provided with male-side low-melting-point layers 21L that are laminated at least on both sides of the engagement portion 23 in the width direction. It should be noted that the male-side low-melting-point layers 21L are provided all over the surface opposite the surface having the engagement portion 23 in some embodiments.

The same tight seal layer 22C1 and the easy-peel layer 22C2 as those in the above exemplary embodiments are laminated on a female-side low-melting-point layer 22L. The tight seal layer 22C1 and the easy-peel layer 22C2 are not necessarily laminated on the female-side low-melting-point layer 22L. In some embodiments, the female-side low-melting-point layer 22L is provided only on a side near an edge of the female base 22A with respect to the tight seal layer 22C1 and the easy-peel layer 22C2 so that the easy-peel layer 22C2 is not laminated on the female-side low-melting-point layer 22L.

It should be noted that, though the sides of the female belt-shaped base 22A, the tight seal layer 22C1, and the easy-peel layer 22C2 to be bonded with the bag body 10 are illustrated to be flush with each other in FIG. 18 for the convenience of description, the layers are sequentially laminated on the male belt-shaped base 21A and the female belt-shaped base 22A in some embodiments.

The male-side low-melting-point layers 21L and the female-side low-melting-point layer 22L are formed of, for instance, random polypropylene (R-PP) respectively integrally with the male belt-shaped base 21A and the female belt-shaped base 22A, which are made of homo polypropylene (H-PP), by co-extrusion or the like.

The embodiment shown in FIG. 18 allows the zipper tape 20 to be reliably bonded to the bag body 10 by the male-side low-melting-point layers 21L and the female-side low-melting-point layer 22L.

Specifically, the seal bar used in bonding the to-be-cantilevered female belt-shaped base 22A onto the film 11B is configured to press both sides of the female belt-shaped base 22A in the width direction. Further, the seal bar is partially made of a heat insulating material so as not to be heated at a portion configured to press a side of the zipper tape (non-bonded side) not provided with the female-side low-melting-point layer 22L. The female-side low-melting-point layer 22L provided on the to-be-bonded side of the female belt-shaped base 22A as shown in the embodiment shown in FIG. 18 contributes to increase a difference between melting temperatures of the to-be-bonded side and not-to-be-bonded side. Accordingly, the female belt-shaped base 22A can be easily bonded without requiring strict temperature control, which is required in order to prevent blocking on the not-to-be-bonded side due to the influence of the heat accumulated in the heat insulating material of the seal bar or the like.

Thus, the cantilevered arrangement can be more reliably achieved, so that the male belt-shaped base 21A and the female belt-shaped base 22A are kept from being peeled from the bag body 10 irrespective of the pressure increase in the housing space 100 of the bag body 10, thereby easily increasing the internal pressure.

Though the female belt-shaped base 22A of the female member 22 has the first portion S1 and the second portion S2 in the above exemplary embodiments, the male belt-shaped base 21A of the male member 21 has the first portion S1 and the second portion S2 in some embodiments of the invention.

Further, though the extension 22E is provided on the female belt-shaped base 22A in the second and third exemplary embodiments, the extension 22E is provided on the male belt-shaped base 21A in some embodiments of the invention. In this case, the extension 22E is bonded to the film 11B.

The invention claimed is:

1. A zipper tape comprising:

a first belt-shaped base and a second belt-shaped base; and a first engagement portion and a second engagement portion being provided integrally with the first and second belt-shaped bases respectively and being mutually engageable with each other, wherein at least two layers are provided on a side of the first belt-shaped base opposite the side provided with the first engagement portion, the at least two layers comprising a first layer made of a first resin composition and a second layer made of a second resin composition different from the first resin composition, each of the first and second layers continuously extend in a longitudinal direction of the first belt-shaped base, and in a width direction of the first belt-shaped base the first layer is formed in a region between an edge and a first position while the second layer is formed in a region between the first position and a second position of the first engagement portion.

2. The zipper tape according to claim 1, wherein the first belt-shaped bases comprises an extension at an end opposite a part provided with the first and second layers with respect to the point at which the first engagement portion is provided in the width direction when the engagement portion is engaged, the extension being extended beyond a length of the second belt-shaped bases, the extension is provided with a sealable portion on a side provided with the first engagement portion, the sealable portion being belt-shaped along the longitudinal direction of the first belt-shaped base and bonded to a film with a bonding strength smaller than the first bonding strength.

3. The zipper tape according to claim 1, wherein the first belt-shaped bases comprises an extension at an end opposite a part provided with the first and second layers with respect to the point at which the first engagement portion is provided in the width direction when the engagement portion is engaged, the extension being extended beyond a length of the second belt-shaped bases, the extension is provided with a cut portion, at which the extension is configured to be cut in the width direction, along the longitudinal direction of the first belt-shaped bases, and the extension is provided with a bondable region bonded to a film at a part opposite the engagement portion with respect to the cut portion.

4. The zipper tape according to claim 1, wherein the engagement portion includes a male portion and a female portion, and the first and second layers are provided on the first belt-shaped bases provided with the female portion.

5. The zipper tape according to claim 1, wherein the first later is made of polypropylene, and the second layer is made of a mixture layer of polyethylene and polypropylene.

6. The zipper tape according to claim 1, wherein the first and second belt-shaped bases are connected to each other via a connecting portion at an end opposite an area provided with the first and second layers with respect to the point at which the first engagement portion is provided, in the width direction.

7. The zipper tape according to claim 1, wherein the first resin composition includes polypropylene and the second resin composition includes no polypropylene or includes polypropylene in lower mixture ratio than the first resin composition.

* * * * *